US010513760B2

(12) United States Patent
Suetsuna et al.

(10) Patent No.: US 10,513,760 B2
(45) Date of Patent: Dec. 24, 2019

(54) METHOD FOR PRODUCING MAGNETIC MATERIAL

(71) Applicant: Kabushiki Kaisha Toshiba, Minato-ku (JP)

(72) Inventors: Tomohiro Suetsuna, Kawasaki (JP); Koichi Harada, Bunkyo (JP); Tomoko Eguchi, Yokohama (JP); Toshihide Takahashi, Yokohama (JP); Seiichi Suenaga, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 943 days.

(21) Appl. No.: 14/842,205

(22) Filed: Sep. 1, 2015

(65) Prior Publication Data

US 2016/0086728 A1 Mar. 24, 2016

(30) Foreign Application Priority Data

Sep. 19, 2014 (JP) ..... 2014-191746

(51) Int. Cl.
*C22C 38/08* (2006.01)
*B22F 9/04* (2006.01)
(Continued)

(52) U.S. Cl.
CPC ..... *C22C 38/08* (2013.01); *B22F 9/04* (2013.01); *C21D 8/12* (2013.01); *C22C 1/00* (2013.01); *C22C 38/02* (2013.01); *C22C 38/06* (2013.01)

(58) Field of Classification Search
CPC ..... B22F 2998/10; B22F 9/04; B22F 1/0085; B22F 1/025; B22F 1/0018; B22F 2009/041; C21D 8/12; C22C 1/00; C22C 1/0433; C22C 33/0257; C22C 38/02; C22C 38/06; C22C 38/08; H01F 1/0063
See application file for complete search history.

(56) References Cited

U.S. PATENT DOCUMENTS

2003/0190498 A1 10/2003 Fujieda et al.
2006/0214855 A1 9/2006 Harada et al.
(Continued)

FOREIGN PATENT DOCUMENTS

CN 102969105 A 3/2013
CN 102969109 A 3/2013
(Continued)

*Primary Examiner* — Veronica F Faison
(74) *Attorney, Agent, or Firm* — Oblon, McClelland, Maier & Neustadt, L.L.P.

(57) ABSTRACT

Provided is a method for producing a magnetic material. The method includes preparing magnetic metal particles containing at least one magnetic metal selected from a first group consisting of Fe, Co and Ni, and at least one non-magnetic metal selected from a second group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, pulverizing and reaggregating the magnetic metal particles, and thereby forming composite particles containing a magnetic metal phase and an interstitial phase, and heat-treating the composite particles at a temperature of from 50° C. to 800° C. The particle size distribution of the magnetic metal particles in the preparing magnetic metal particles has two or more peaks.

20 Claims, 1 Drawing Sheet

(51) Int. Cl.

| | |
|---|---|
| ***C22C 1/00*** | (2006.01) |
| ***C21D 8/12*** | (2006.01) |
| ***C22C 38/02*** | (2006.01) |
| ***C22C 38/06*** | (2006.01) |

(56) References Cited

U.S. PATENT DOCUMENTS

| | | | | |
|---|---|---|---|---|
| 2007/0102663 | A1* | 5/2007 | Xiao | B82Y 25/00 252/62.51 C |
| 2010/0060538 | A1* | 3/2010 | Suetsuna | H01F 1/33 343/787 |
| 2011/0017501 | A1 | 1/2011 | Ohmi et al. | |
| 2011/0217543 | A1* | 9/2011 | Suetsuna | B32B 5/16 428/323 |
| 2013/0228716 | A1 | 9/2013 | Suetsuna et al. | |
| 2013/0228717 | A1* | 9/2013 | Harada | H01F 1/26 252/62.55 |

FOREIGN PATENT DOCUMENTS

| | | | |
|---|---|---|---|
| JP | 7-62401 | A | 3/1995 |
| JP | 2001-358493 | A | 12/2001 |
| JP | 2004-60023 | A | 2/2004 |
| JP | 2006-128278 | A | 5/2006 |
| JP | 1838345 | A | 9/2008 |
| JP | 2009-249673 | | 10/2009 |
| JP | 2011-187568 | | 9/2011 |
| JP | 2012-151502 | A | 8/2012 |
| JP | 2013-51329 | | 3/2013 |
| JP | 2013-65844 | | 4/2013 |
| JP | 2014-131054 | A | 7/2014 |

* cited by examiner

METHOD FOR PRODUCING MAGNETIC MATERIAL

CROSS-REFERENCE TO RELATED APPLICATION

This application is based upon and claims the benefit of priority from Japanese Patent Application No. 2014-191746, filed on Sep. 19, 2014, the entire contents of which are incorporated herein by reference.

FIELD

Embodiments described herein relate generally to a method for producing a magnetic material.

BACKGROUND

Currently, magnetic materials are being applied to the component parts of various devices such as inductor elements, electromagnetic wave absorbers, magnetic inks, and antenna apparatuses. These component parts utilize the characteristics of the real part of the magnetic permeability (real part of the relative magnetic permeability) μ' or the imaginary part of the magnetic permeability (imaginary part of the relative magnetic permeability) μ" possessed by magnetic materials, according to the purpose. For example, inductance elements or antenna devices utilize high μ' (and low μ"), while electromagnetic wave absorbers utilize high μ". For this reason, in a case in which such component parts are actually used in devices, it is preferable that the characteristics μ' and μ" be controlled in accordance with the working frequency band in the equipment.

In recent years, adjustment of the working frequency band in equipment to higher frequency bands is in progress, and there is an urgent need for the development of a magnetic material having excellent characteristics with high μ' and low μ" at high frequencies.

DETAILED DESCRIPTION

Figure 1A:
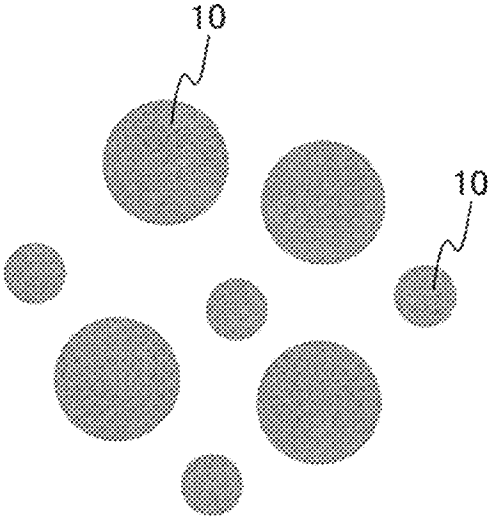
FIG. 1A is a schematic diagram illustrating a magnetic material according to an embodiment of the invention in which magnetic metal particles do not have a coating layer.

A method for producing a magnetic material according an embodiment of the invention includes preparing magnetic metal particles containing at least one magnetic metal selected from a first group consisting of iron (Fe), cobalt (Co) and nickel (Ni), and at least one non-magnetic metal selected from a second group consisting of magnesium (Mg), aluminum (Al), silicon (Si), calcium (Ca), zirconium (Zr), titanium (Ti), hafnium (Hf), zinc (Zn), manganese (Mn), barium (Ba), strontium (Sr), chromium (Cr), molybdenum (Mo), silver (Ag), gallium (Ga), scandium (Sc), vanadium (V), yttrium (Y), niobium (Nb), lead (Pb), copper (Cu), indium (In), tin (Sn), and rare earth elements, the particle size distribution of the magnetic metal particles having two or more peaks; pulverizing and reaggregating the magnetic metal particles and thereby forming composite particles containing a magnetic metal phase and an interstitial phase; and heat-treating the composite particles at a temperature of from 50° C. to 800° C.

Magnetic materials having high μ' and low μ" are used in inductance elements, antenna apparatuses and the like; however, among them, particular attention has been paid in recent years to the application of the magnetic materials in power inductance elements that are used in power semiconductors. In recent years, the importance of energy saving and environment protection has been actively advocated, and the abatement of $CO_2$ emission and a decrease in the dependency on fossil fuels have become indispensable.

As a result, development of electric vehicles and hybrid vehicles that substitute gasoline vehicles is inactive progress. Also, the technologies for utilizing natural energies such as solar power generation and wind power generation are regarded as key technologies to an energy-saving society, and various developed countries have actively promoted the development of technologies for utilizing natural energies. Furthermore, as an environment-friendly electric power saving system, the importance of establishment of home energy management systems (HEMS) and building and energy management systems (BEMS) that control the electric power generated by solar power generation, wind power generation and the like through smart grids, and supply the electric power to homes, offices and industrial plants at high efficiency, is being actively advocated.

In such a trend for energy savings, power semiconductors play a key role. Power semiconductors are semiconductors which control high electric power or energy with high efficiency, and include power discrete semiconductors such as insulated gate bipolar transistors (IGBT), metal oxide semiconductor field-effect transistors (MOSFET), power bipolar transistors, and power diodes, as well as power supply circuits such as linear regulators and switching regulators, and logic large scale integration (LSI) for power management to control these devices.

Power semiconductors are widely used in all equipment in the applications of electrical appliances, computers, automobiles, railway transportation and the like, and there can be expected an increase in the distribution of these applied instruments and an increase in the mounting ratios of power semiconductors in these instruments. Therefore, an extensive growth in the market for power semiconductors in the future is anticipated. For example, in the inverters that are mounted in many electrical appliances, power semiconductors are used to an extent that may well be said to be almost the entirety of the inverters, and extensive energy saving is made possible thereby.

Currently, silicon (Si) constitutes the mainstream of power semiconductors; however, it is believed that for the purpose of an enhancement of efficiency and miniaturization of instruments, it is effective to use SiC and GaN. SiC or GaN has a larger band gap or a larger dielectric breakdown electric field than Si, and since SiC or GaN can increase the withstand voltage, the thickness of elements can be decreased. Accordingly, the on-resistance of semiconductors can be decreased, and these substances are effective in decreasing losses and increasing efficiency. Furthermore, since SiC or GaN has higher carrier mobility, the switching frequency can be adjusted to high frequencies, and it is effective for the miniaturization of elements. Moreover, particularly, since SiC has higher thermal conductivity than Si, SiC has higher thermal dissipation capacity and enables operation at high temperatures. Thus, simplification of the cooling mechanism can be achieved, and this is effective in miniaturization of elements.

From the viewpoints described above, development of SiC and GaN power semiconductors is in active progress. In order to realize the development, the development of power inductor elements that are used together with power semiconductors, that is, the development of high permeability magnetic materials (high μ' and low μ"), is underway. In this case, regarding the characteristics required from magnetic materials, high magnetic permeability in the driving frequency band, low magnetic losses, as well as high saturation magnetization capable of coping with large electric currents are preferred. If the saturation magnetization is high, it is not easy to induce magnetic saturation even if a high magnetic field is applied, and an effective decrease in the inductance value can be suppressed. Thereby, the direct current superimposition characteristics of devices are enhanced, and the efficiency of systems is enhanced.

Examples of a magnetic material for systems of several kilowatt (kW)-class at 10 kHz to 100 kHz include Sendust (Fe—Si—Al), nanocrystalline Finemet (Fe—Si—B—Cu—Nb), ribbons and pressed powders of Fe-based/Co-based amorphous glass, and MnZn-based ferrite materials. However, all of them do not satisfy characteristics such as high magnetic permeability, low loss, high saturation magnetization, high thermal stability, and high oxidation resistance, and are therefore not satisfactory.

Furthermore, it is anticipated that the driving frequency of systems will be further adjusted to higher frequencies in the future, along with the popularization of SiC and GaN semiconductors, and characteristics such as high magnetic permeability and low loss in the megahertz (MHz) range of 100 kHz or higher are preferred. Therefore, there is a demand for the development of a magnetic material which satisfies high magnetic permeability and low loss in the MHz range of 100 kHz or higher, while satisfying high saturation magnetization, high thermal stability and high oxidation resistance.

Furthermore, a magnetic material having high μ' and low μ" at a high frequency is also expected to be applicable to the devices of high frequency communication equipment, such as antenna apparatuses. As a method for decreasing the size of antennas and saving more electric power, there is available a method of dragging electromagnetic waves that reach an electronic component part or a substrate in a communication instrument from an antenna by using an insulating substrate having high magnetic permeability (high μ' and low μ") as an antenna substrate, and achieving transmission and reception of electromagnetic waves without allowing the electromagnetic waves to reach the electronic component part or substrate. Thereby, size reduction of antennas and electric power saving are enabled, and at the same time, broadbanding of the resonance frequency of antennas is also enabled, which is preferable.

Even for such applications, in the event that a magnetic material for power inductor elements described above has been developed, there is a possibility that the magnetic material may be applied to the applications, and thus it is preferable.

Furthermore, in electromagnetic wave absorbers, noises generated from electronic equipment are absorbed by utilizing high μ", and thus inconveniences such as malfunction of electronic equipment are reduced. Examples of the electronic equipment include semiconductor elements such as integrated circuit (IC) chips, and various communication instruments. Such electronic equipment is used in various frequency bands, and high μ" in a predetermined frequency band is demanded. Generally, a magnetic material has high W near a ferromagnetic resonance frequency. However, if various magnetic losses other than the ferromagnetic resonance loss, for example, the eddy current loss and the magnetic domain wall resonance loss, can be suppressed, μ" can be decreased while μ' can be increased, in a frequency band sufficiently lower than the ferromagnetic resonance frequency.

That is, even a single material may be used as a high permeability component part, or may be used as an electromagnetic wave absorber, by changing the working frequency band. Therefore, in the event that a magnetic material for power inductors described above has been developed, even in an application for electromagnetic wave absorbers utilizing μ", there is a possibility that the magnetic material may be applied by adjusting the ferromagnetic resonance frequency to the frequency band of use.

On the other hand, a material that is developed as an electromagnetic wave absorber is usually designed so as to have maximized μ" by summing up all the losses composed of various magnetic losses such as the ferromagnetic resonance loss, the eddy current loss, and the magnetic domain wall resonance loss. For this reason, it is not preferable to use a material that is developed as an electromagnetic wave absorber, as a high permeability component part (high μ' and low μ") for the inductor elements and antenna apparatuses, even in any frequency band.

Electromagnetic wave absorbers have been conventionally produced by a binding molding method of mixing ferrite particles, carbonyl iron particles, FeAlSi flakes, FeCrAl flakes and the like with a resin. However, all of these materials have extremely low μ' and μ" in high frequency bands, and do not necessarily give satisfactory characteristics. In addition to that, materials that are synthesized by a mechanical alloying method or the like have a problem that the long-term thermal stability is insufficient, and the product yield is low.

As discussed above, various materials have been suggested hitherto as the magnetic materials to be used in power inductor elements, antennas, and electromagnetic absorbers.

Hereinafter, embodiments will be explained using the attached drawings. Meanwhile, identical or similar symbols have been assigned to identical or similar parts in the drawings.

Present Embodiment

The method for producing a magnetic material of the present embodiment includes preparing magnetic metal particles containing at least one magnetic metal selected from a first group consisting of Fe, Co and Ni, and at least one non-magnetic metal selected from a second group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, with the particle size distribution of the magnetic metal particles having two or more peaks; pulverizing and reaggregating the magnetic metal particles, and thereby forming composite particles containing a magnetic metal phase and an interstitial phase; and heat-treating the composite particles at a temperature of from 50° C. to 800° C.

When the production method of the present embodiment is used, a magnetic material can be produced with high product yield and in a state of having high stability over time. In this case, not only excellent magnetic characteristics such as high saturation magnetization, high magnetic permeability and low magnetic losses can be realized, but also excellent mechanical characteristics such as high strength and high toughness can be realized.

Figure 1B:
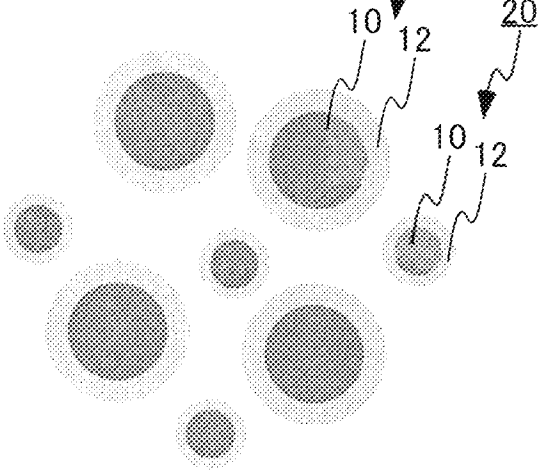
FIG. 1B is a schematic diagram of core-shell type magnetic particles.
Figure 1C:
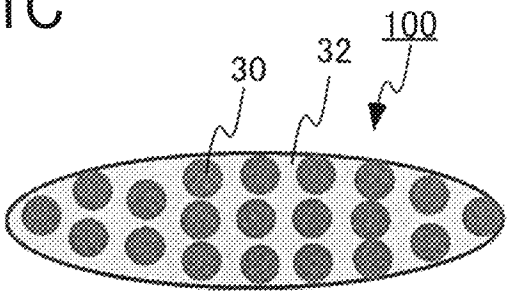
FIG. 1C is a schematic diagram of a magnetic material.

FIGS. 1A-1C are schematic diagrams illustrating the magnetic material of the present embodiment. FIG. 1A is a schematic diagram of magnetic metal particles 10 that do not have a coating layer 12. FIG. 1B is a schematic diagram of core-shell type magnetic particles 20. Reference numeral 10 represents magnetic metal particles, and reference numeral 12 represents a coating layer. FIG. 1C is a schematic diagram of a magnetic material 100. Reference numeral 30 represents a metal nanoparticle, and reference numeral 32 represents an interstitial phase.

The production method of the present embodiment is particularly effective in a case in which a magnetic material 100 such as described below is produced. That is, a magnetic material 100 including magnetic particles, which are particle aggregates containing metal nanoparticles 30 that have an average particle size of from 1 nm to 100 nm, preferably from 1 nm to 20 nm, and more preferably from 1 nm to 10 nm, and contain at least one magnetic metal selected from the group consisting of Fe, Co and Ni; and an interstitial phase 32 that is present between the metal nanoparticles 30 and contains at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, and any one of oxygen (O), nitrogen (N) or carbon (C), the particle aggregates having a shape with an average short dimension of from 10 nm to 2 μm, and preferably from 10 nm to 100 nm, and an average aspect ratio of 5 or more, and preferably 10 or more, and in which particles the volume packing ratio of the metal nanoparticles 30 relative to the entirety of the particle aggregates is from 40 vol % to 80 vol %, can be produced with high product yield and in a state of having high stability over time.

The present production method is a production method adequate for synthesizing a magnetic material 100 in which the average interparticle distance of the metal nanoparticles 30 is from 0.1 nm to 5 nm. The metal nanoparticles 30 have an average particle size of from 1 nm to 100 nm, preferably from 1 nm to 20 nm, and more preferably from 1 nm to 10 nm. If the average particle size is adjusted to be less than 1 nm, there is a risk that superparamagnetism may occur and the amount of magnetic flux may be decreased. On the other hand, if the average particle size is more than 10 nm, it is not preferable because the magnetic interaction through magnetic exchange coupling becomes weak. The most preferred particle size range for enhancing the magnetic interaction through magnetic exchange coupling between particles while maintaining a sufficient amount of magnetic flux, is from 1 nm to 10 nm.

In regard to the average particle size of the metal nanoparticles 30, the average particle size can be determined by observing a large number of particles with a transmission electron microscope (TEM) and averaging the particle sizes of the particles; however, when it is difficult to determine the particle size by TEM, the particle size can be substituted by the crystal grain size that can be determined from an X-ray diffraction (XRD) analysis. That is, the crystal grain size can be determined by XRD using Scherrer's formula from the diffraction angle and the full width at half maximum in connection with the maximum peak among the peaks attributable to magnetic metals. Scherrer's formula is represented by $D=0.9\lambda/(\beta \cos \theta)$, in which D represents the crystal grain size; $\lambda$ represents the wavelength of the X-ray used for measurement; $\beta$ represents the full width at half maximum; and $\theta$ represents the Bragg diffraction angle. However, in regard to the crystal grain size analysis by Scherrer's formula by XRD, an accurate analysis not easily achieved in the case of a particle size of approximately 50 nm or more, and caution should be taken. In general, in the case of a particle size of 50 nm or more, it is necessary to determine the particle size through observation by TEM.

The metal nanoparticles 30 may be in any of a polycrystalline form or a single crystalline form; however, it is preferable that the metal nanoparticles 30 be single crystalline. In the case of single crystalline metal nanoparticles 30, alignment of the axis of easy magnetization is facilitated, and magnetic anisotropy can be controlled. For this reason, the high frequency characteristics can be enhanced as compared with the case of polycrystalline magnetic metal nanoparticles (30).

Furthermore, the metal nanoparticles 30 may have a spherical shape; however, the metal nanoparticles may also have a flat shape or a rod shape, both of which have large aspect ratios. Particularly, it is preferable that the average of the aspect ratio be 2 or more, more preferably 5 or more, and even more preferably 10 or more. In the case of metal nanoparticles 30 having a large aspect ratio, it is more desirable to make the longer side direction (in the case of a plate shape, the width direction; in the case of an oblate ellipsoid, the diameter direction; in the case of a rod shape, the length direction of the rod; and in the case of a spheroid, the major axis direction) of individual metal nanoparticles 30 to coincide with the longer side direction (in the case of a plate shape, the width direction; in the case of an oblate ellipsoid, the diameter direction; in the case of a rod shape, the length direction of the rod; and in the case of a spheroid, the major axis direction) of the magnetic particles (particle aggregates). Thereby, the directions of the axes of easy magnetization can be aligned, and the magnetic permeability and the high frequency characteristics of the magnetic permeability can be enhanced.

Furthermore, it is preferable that the metal nanoparticles 30 form a nanoparticle aggregate structure in which the metal nanoparticles are in point contact or in surface contact, and this nanoparticle aggregate structure be primarily oriented in a certain single direction within a particle aggregate. More preferably, it is more preferable that the particle aggregates have a flat shape, plural metal nanoparticles 30 be brought into contact and form a rod-shaped nanoparticle aggregate structure, and the nanoparticle aggregate structure be primarily oriented in a certain single direction within a flat plane of the particle aggregate. Furthermore, a larger aspect ratio of the nanoparticle aggregate structure is more preferable, and the average of the aspect ratios is preferably 2 or more, more preferably 5 or more, and even more preferably 10 or more.

Here, on the occasion of calculating the aspect ratio of a nanoparticle aggregate structure, the shape of the nanoparticle aggregate structure is defined as follows. That is, in a case in which plural metal nanoparticles 30 are in point contact or in surface contact and thereby form a single nanoparticle aggregate structure, the contour line of the nanoparticle aggregate structure is produced such that the contour line surrounds all the metal nanoparticles 30 included in the single nanoparticle aggregate structure. However, in a case in which a contour line of a neighboring metal nanoparticle 30 is drawn from the contour line of a single metal nanoparticle 30, the contour line is drawn as a tangent line of both the metal nanoparticles 30. For example, in a case in which a plural number of spherical metal nanoparticles 30 having the same particle size are in point contact in a linear form and form a nanoparticle aggregate structure, the nanoparticle aggregate structure becomes a nanoparticle aggregate structure having a linear rod shape. When the shape of a nanoparticle aggregate structure is defined as described above, the aspect ratio refers to the ratio of the dimension of the structure in the direction in which the length of the nanoparticle aggregate structure becomes the longest (long dimension), to the dimension of the particle in a direction perpendicular to the aforementioned direction, in which the length of the nanoparticle aggregate structure becomes the shortest (short dimension), that is, the ratio of "long dimension/short dimension". Therefore, the aspect ratio is always 1 or higher. In the case of a perfect spherical shape, since both the long dimension and the short dimension are identical to the diameter of the sphere, the aspect ratio is 1. The aspect ratio of a flat shape is the ratio of diameter (long dimension)/height (short dimension). The aspect ratio of a rod shape is the ratio of the length of the rod (long dimension)/the diameter of the bottom of the rod (short dimension). However, the aspect ratio of a spheroid is the ratio of major axis (long dimension)/minor axis (short dimension). Whether a nanoparticle aggregate structure is primarily oriented in a certain single direction within the particle aggregate, can be determined by performing an image analysis on observation images obtained by TEM. For example, the following method may be employed. First, the long dimension and the short dimension of a nanoparticle aggregate structure are determined by the method described above, the direction of a certain single reference line is determined, and thereby it is determined at which angle each of individual nanoparticle aggregate structures is oriented with respect to the reference line (angle of orientation). This is performed on a large number of nanoparticle aggregate structures, and the abundances of nanoparticle aggregate structures for the respective angles of orientation are determined. Thus, it is determined whether the nanoparticle aggregate structures are oriented in a certain single direction, as compared with the case of random orientation (not oriented). An analysis such as described above can also be carried out by an image analysis using Fourier transformation. By adopting a configuration such as described above, the directions of the axes of easy magnetization can be aligned into one direction, and the magnetic permeability and the high frequency characteristics of the magnetic permeability can be enhanced, which is preferable.

Furthermore, it is preferable that an interstitial phase 32 having a resistivity of 1 mΩ·cm or more and containing at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, and any one of oxygen (O), nitrogen (N) or carbon (C), exist between the metal nanoparticles 30. These non-magnetic metals are elements which have small standard Gibbs energy of formation of oxides and are therefore susceptible to oxidation, and these non-magnetic metals are preferably metals that can easily form stable oxides. When an interstitial phase 32 of a metal, a semiconductor, an oxide, a nitride, a carbide or a fluoride of such a non-magnetic metal is present between the metal nanoparticles 30, the electrical insulating properties between the metal nanoparticles 30 can be further enhanced, and the thermal stability of the metal nanoparticles 30 can be enhanced, which is preferable.

Furthermore, it is preferable that the interstitial phase 32 of a metal, a semiconductor, an oxide, a nitride, a carbide or a fluoride contain at least one of the magnetic metals described above. When the metal, semiconductor, oxide, nitride, carbide or fluoride contains at least one of metals that are the same as the magnetic metals contained in the metal nanoparticles 30, thermal stability and oxidation resistance are enhanced. Furthermore, when ferromagnetic components exist between the metal nanoparticles 30, the magnetic interaction between magnetic metal nanoparticles becomes stronger. For this reason, the metal nanoparticles 30 and the interstitial phase 32 can behave like magnetic aggregates, and the magnetic permeability and the high frequency characteristics of the magnetic permeability can be enhanced.

Furthermore, similarly, when the interstitial phase 32 of a metal, a semiconductor, an oxide, a nitride, a carbide or a fluoride contains at least one of non-magnetic metals that are the same as the non-magnetic metals contained in the metal nanoparticles 30, it is preferable because thermal stability and oxidation resistance are enhanced. Meanwhile, when the interstitial phase 32 contains at least one each of the magnetic metals and the non-magnetic metals contained in the metal nanoparticles 30, it is desirable that the atom ratio of non-magnetic metal/magnetic metal in the interstitial phase 32 be larger than the atom ratio of non-magnetic metal/magnetic metal contained in the metal nanoparticles 30. This is because the metal nanoparticles 30 can be blocked by the "interstitial phase 32 having a high ratio of non-magnetic metal/magnetic metal", which has high oxidation resistance and high thermal stability, and thus the oxidation resistance and thermal stability of the metal nanoparticles 30 can be effectively increased.

Furthermore, it is desirable that the content of oxygen contained in the interstitial phase 32 be larger than the content of oxygen in the metal nanoparticles 30. This is because the metal nanoparticles 30 can be blocked by the "interstitial phase 32 having a high oxygen concentration and having high oxidation resistance and thermal stability", and thus the oxidation resistance and thermal stability of the metal nanoparticles 30 can be effectively increased. Among a metal, a semiconductor, an oxide, a nitride, a carbide and a fluoride, an oxide is more preferred from the viewpoint of thermal stability. The interstitial phase 32 of a metal, an oxide, a nitride, a carbide or a fluoride may be in a particulate form. In the case of an interstitial phase 32 adopting a particulate form, it is desirable that the particles of the interstitial phase 32 be particles having a particle size smaller than the particle size of the metal nanoparticles 30. In this case, the particles may be oxide particles, may be nitride particles, may be carbide particles, or may be fluoride particles. However, from the viewpoint of thermal stability, it is more preferable that the particles be oxide particles. In the following descriptions, the case in which the entirety of the interstitial phase 32 is composed of oxide particles will be described as an example. Meanwhile, a more preferred state of existence of the oxide particles is a state in which the oxide particles are uniformly and homogeneously dispersed between the metal nanoparticles 30. Thereby, more uniform magnetic characteristics and dielectric characteristics can be expected. These oxide particles can not only enhance the oxidation resistance and the aggregation inhibitory power of the metal nanoparticles 30, that is, the thermal stability of the metal nanoparticles 30, but also can increase the electrical resistance of the particle aggregates and the magnetic material by electrically separating the metal nanoparticles 30. When the electrical resistance of the magnetic material is increased, the eddy current loss at a high frequency is suppressed, and thus the high frequency characteristics of the magnetic permeability can be enhanced. For this reason, it is preferable that the oxide particles have high electrical resistance, and preferably have a resistance value of, for example, 1 mΩ·cm or more.

The oxide particles contain at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and rare earth elements. These non-magnetic metals are elements which have small standard Gibbs energy of formation of oxides and are therefore susceptible to oxidation, and these non-magnetic metals can easily form stable oxides. Also, in a case in which the metal nanoparticles 30 include a coating layer, it is preferable that the ratio of non-magnetic metal/magnetic metal (atom ratio) in these oxide particles be larger than the ratio of non-magnetic metal/magnetic metal (atom ratio) in the coating layer that covers the metal nanoparticles 30. As such, when the proportion of non-magnetic metals is high, the oxide particles become more thermally stable than the coating layer. Accordingly, when such oxide particles are present at least in a portion of the space between the metal nanoparticles 30, the electrical insulating properties between the metal nanoparticles 30 can be further enhanced, and the thermal stability of the magnetic metal nanoparticles 30 can be enhanced. Meanwhile, the oxide particles may not contain magnetic metals; however, more preferably, it is desirable that the oxide particles contain magnetic metals. A preferred amount of the magnetic metals included therein is 0.001 atom % or more, and preferably 0.01 atom % or more, with respect to the non-magnetic metals. This is because if the oxide particles do not contain magnetic metals at all, the constituent components of the coating layer that covers the surface of the metal nanoparticles 30 and the constituent components of the oxide particles completely differ from each other, which is not so preferable from the viewpoints of adhesiveness and strength, and there is a possibility that thermal stability may be rather deteriorated. Furthermore, if the oxide particles existing between the metal nanoparticles 30 do not contain magnetic metals at all, it is difficult for the metal nanoparticles 30 to simultaneously magnetically interact with neighboring particles, and it is not preferable from the viewpoint of the magnetic permeability and the high frequency characteristics of the magnetic permeability. Therefore, more preferably, it is desirable that the oxide particles contain at least one of the magnetic metals which are constituent components of the metal nanoparticles 30 and are also constituent components of the oxide coating layer, and even more preferably, it is desirable that the ratio of non-magnetic metal/magnetic metal (atom ratio) in the oxide particles be larger than the ratio of non-magnetic metal/magnetic metal (atom ratio) in the oxide coating layer. Meanwhile, it is more preferable that the oxide particles be oxide particles containing non-magnetic metals of the same kinds as the non-magnetic metals contained in the metal nanoparticles 30 and of the same kinds as the non-magnetic metals contained in the oxide coating layer. It is because when the oxide particles are oxide particles containing non-magnetic metals of the same kinds, the thermal stability and the oxidation resistance of the magnetic metal nanoparticles 30 are further enhanced. Incidentally, the thermal stability enhancing effect, electrical insulating properties effect, and the adhesiveness and strength enhancing effect of the oxide particles described above are manifested particularly when the average particle size of the metal nanoparticles 30 is small, and it is particularly effective in a case in which the oxide particles have a particle size smaller than the particle size of the metal nanoparticles 30. Furthermore, it is preferable that the volume packing ratio of the metal nanoparticles 30 be from 30 volt to 80 volt relative to the total amount of the particle aggregates. The volume packing ratio is more preferably from 40 vol % to 80 vol %, and even more preferably from 50 vol % to 80 vol %.

In the magnetic material 100 formed from such particle aggregates, the metal nanoparticles 30 can easily magnetically interact with neighboring particles, and magnetically behave as a single aggregate. On the other hand, since the interstitial phase 32 having high electrical resistance, for example, oxides are present between the metal nanoparticles 30, in view of electrical characteristics, the electrical resistance of the magnetic material 100 can be made larger. Therefore, the eddy current loss can be suppressed while high magnetic permeability is maintained, which is preferable.

Next, the production method according to the present embodiment will be explained in detail. According to the present embodiment, first, magnetic metal particles 10 containing at least one magnetic metal selected from the group consisting of Fe, Co and Ni, and at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, with the particle size distribution of the magnetic metal particles having two or more peaks, are provided. It is preferable that the composite particles contain a magnetic metal phase and an interstitial phase. Here, the magnetic metal phase refers to a phase exhibiting magnetism and containing at least one magnetic metal selected from the group consisting of Fe, Co, and Ni. The interstitial phase refers to another phase different from the magnetic metal phase, and containing, for example, any one of oxygen (O), nitrogen (N), or carbon (C).

It is preferable that the composite particles contain any one of oxygen (O), nitrogen (N), or carbon (C). Also, in the first step (preparing the magnetic metal particles), it is desirable to prepare core-shell type magnetic particles 20 having a coating layer 12 that covers at least a portion of the surface of the magnetic metal particles 10 and contains at least one each of the magnetic metals and the non-magnetic metals contained in the magnetic metal particles 10, and any one of oxygen (O), nitrogen (N), or carbon (C). Alternatively, it is also acceptable to employ a method of forming composite particles containing any one of oxygen (O), nitrogen (N) or carbon (C) by partially incorporating any one of oxygen (O), nitrogen (N) or carbon (C) into the magnetic metal particles 10 when the magnetic metal particles 10 are treated in the second step (pulverizing and reaggregating the magnetic metal particles). At this time, a portion of the magnetic metal particles 10 become oxides, nitrides or carbides. In this case, since the magnetic metal particles are metallic in the first stage of the first step (preparing the magnetic metal particles), composite particles are likely to be formed in a state of being highly slippery from the viewpoints of ductility and malleability and having less strain. Therefore, it is preferable from the viewpoints of a decrease in the coercivity, a decrease in the hysteresis loss, and an increase in the magnetic permeability. The any one element of oxygen (O), nitrogen (N) or carbon (C) contained in the composite particles may be any element; however, oxygen (O) is more preferred from the viewpoints of thermal stability and oxidation resistance. Hereinafter, the case in which the element is mainly oxygen (O) will be explained as an example.

When the magnetic metal particles 10 or the core-shell type magnetic particles 20 are prepared, the method for producing the particles is not particularly limited. For example, core-shell type magnetic particles 20 can be produced by first synthesizing magnetic metal particles 10, and then forming a coating layer 12 by a coating treatment. Here, the magnetic metal particles 10 are synthesized by, for example, a water atomization method, a gas atomization method, a heat plasma method, a chemical vapor deposition (CVD) method, a laser ablation method, an in-liquid dispersion method, or a liquid phase polymerization method (a polyol method, a thermal decomposition method, a reverse micelle method, a co-precipitation method, a mechanochemical method, a mechanofusion method, or the like). Furthermore, the magnetic metal particles may also be synthesized by a method of reducing oxide fine particles synthesized by a co-precipitation method or the like. Since this method can synthesize large amounts of metal nanoparticles 30 by a convenient and inexpensive technique, the method is preferable in the case of considering a mass production process. A heat plasma method enables synthesis of large quantities to be carried out easily, which is preferable. In the case of using a heat plasma method, first, raw materials including a magnetic metal powder having an average particle size of several micrometers (μm) and a non-magnetic metal are injected together with a carrier gas into a plasma generated in the chamber of a high frequency induction heat plasma apparatus. Thereby, magnetic metal particles 10 containing a magnetic metal can be easily synthesized. A liquid phase synthesis method is carried out such that a coating treatment is performed continuously in a liquid phase, and this method is preferable from the viewpoints of low cost and high product yield.

The magnetic metal particles 10 contain at least one magnetic metal selected from the group consisting of Fe, Co and Ni. Furthermore, it is more preferable that the magnetic metal particles 10 contain at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and rare earth elements. These non-magnetic metals are preferable because the non-magnetic metals can enhance the resistance of the metal nanoparticles 30 and can enhance thermal stability and oxidation resistance. Among them, Al and Si are preferred because these elements can easily form solid solutions with Fe, Co and Ni, which are main components of the metal nanoparticles 30, and contribute to an enhancement of the thermal stability of the metal nanoparticles 30.

The magnetic metal particles 10 are formed from, for example, an alloy containing Fe, Co and Al, or an alloy containing Fe, Ni and Si.

The magnetic metals contained in the magnetic metal particles 10 include at least one selected from the group consisting of Fe, Co and Ni, and particularly, a Fe-based alloy, a Co-based alloy, a FeCo-based alloy, and a FeNi-based alloy are preferred because these alloys can realize high saturation magnetization. A Fe-based alloy contains Ni, Mn, Cu and the like as a second component, and examples include a FeNi alloy, a FeMn alloy, and a FeCu alloy. A Co-based alloy contains Ni, Mn, Cu and the like as a second component, and examples include a CoNi alloy, a CoMn alloy, and a CoCu alloy. Examples of a FeCo-based alloy include alloys containing Ni, Mn, Cu and the like as the second component. These second components are components effective for enhancing the high frequency magnetic characteristics of the magnetic material that is finally obtained.

A FeNi-based alloy exhibits low magnetic anisotropy, and is therefore a material advantageous for obtaining high magnetic permeability. Particularly, a FeNi alloy having a Fe content of from 40 atom % to 60 atom % is preferable because the alloy exhibits high saturation magnetization and low anisotropy. A FeNi alloy having a Fe content of from 10 atom % to 40 atom %, and particularly from 10 atom % to 30 atom %, does not exhibit such high saturation magnetization; however, since the magnetic anisotropy becomes quite low, the FeNi alloy is preferable as a composition specialized for high magnetic permeability.

A FeCo-based alloy exhibits high saturation magnetization, and therefore, the alloy is preferably used in order to obtain high magnetic permeability. The amount of Co in FeCo is preferably adjusted to from 10 atom % to 50 atom % from the viewpoint of satisfying thermal stability, oxidation resistance, and saturation magnetization of 2 Tesla or higher. A more preferred amount of Co in FeCo is in the range of from 20 atom % to 40 atom %, from the viewpoint of further increasing saturation magnetization.

Regard to the amount of the non-magnetic metals contained in the magnetic metal particles 10, it is preferable that the non-magnetic metals be contained in an amount of from 0.001 atom % to 20 atom % relative to the amount of the magnetic metals. If the contents of the non-magnetic metals are respectively more than 20 atom %, there is a risk that saturation magnetization of the magnetic metal nanoparticles may be decreased. A more preferred amount from the viewpoints of high saturation magnetization and solid solubility is from 0.001 atom % to 5 atom %, and more preferably, it is desirable that the non-magnetic metals be incorporated in an amount in the range of from 0.01 atom % to 5 atom %.

Regarding the crystal structure of the magnetic metal particles 10, a body-centered cubic lattice structure (bcc), a face-centered cubic lattice structure (fcc), and a hexagonal close-packed structure (hcp) may be considered, and each of them has unique features. The bcc structure is advantageous in that since a composition having a large proportion of a Fe-based alloy has the bcc structure, the crystal structure can be easily synthesized in a wide variety. The fcc structure is advantageous in that since the fcc structure can make the diffusion coefficient of a magnetic metal can be made smaller as compared with the bcc structure, thermal stability or oxidation resistance can be made relatively higher. Furthermore, in a case in which particle aggregates are synthesized by integrating the magnetic metal particles 10 and the interstitial phase 32, integration or flattening may proceed easily as compared with the bcc structure or the like, and it is preferable. When integration or flattening proceeds easily, the particle aggregates may have a more refined structure, and a decrease of coercivity (led to a low hysteresis loss), an increase of resistance (led to a low eddy current loss), and an increase of magnetic permeability are promoted, which is preferable. The hcp structure (hexagonal structure) is advantageous in that the magnetic characteristics of a magnetic material can be made to exhibit in-plane uniaxial anisotropy. Since a magnetic metal having the hcp structure generally has high magnetic anisotropy, the magnetic metal can be easily oriented, and the magnetic permeability can be made higher. Particularly, a Co-based alloy is likely to have the hcp structure, and it is preferable. In the case of a Co-based alloy, the hcp structure can be stabilized by incorporating Cr or Al to the alloy, and it is preferable.

Meanwhile, in order to induce in-plane uniaxial anisotropy in a magnetic material, there are available a method of orienting magnetic metal particles 10 having the hcp structure, as well as a method of amorphizing crystallinity of the magnetic metal particles 10 as far as possible, and inducing magnetic anisotropy in an in-plane direction by means of a magnetic field or strain. For this reason, it is preferable that the magnetic metal particles 10 have a composition that can be easily amorphized as far as possible. From such a viewpoint, it is preferable that the magnetic metals contained in the magnetic metal particles 10 contain at least one additive metal selected from a group consisting of boron (B), silicon (Si), carbon (C), titanium (Ti), zirconium (Zr), hafnium (Hf)), niobium (Nb), tantalum (Ta), molybdenum (Mo), chromium (Cr), copper (Cu), tungsten (W), phosphorus (P), nitrogen (N), and gallium (Ga), which are different from the non-magnetic metals, in a total amount of from 0.001 atom % to 25 atom % relative to the total amount of the magnetic metals, the non-magnetic metals and the additive metals, and that at least two of the magnetic metals, the non-magnetic metals and the additive metals form a solid solution of each other.

Meanwhile, in regard to a magnetic material having in-plane uniaxial anisotropy, the anisotropic magnetic field in an easily magnetized plane is preferably from 1 Oe to 500 Oe, and more preferably from 10 Oe to 500 Oe. This is a preferred range for maintaining low loss and high magnetic permeability in the MHz range of 100 kHz or higher. If anisotropy is too low, the ferromagnetic resonance frequency occurs at a low frequency, and a large loss occurs in the MHz range, which is not preferable.

On the other hand, if anisotropy is high, the ferromagnetic resonance frequency becomes high, and low loss can be realized; however, the magnetic permeability is also decreased, which is not preferable. The range of the anisotropic magnetic field that can achieve a balance between high magnetic permeability and low loss is preferably from 1 Oe to 500 Oe, and more preferably from 10 Oe to 500 Oe.

It is preferable that the magnetic metal particles 10 contain oxygen in an amount of from 0.1 wt % to 20 wt %, preferably from 1 wt % to 10 wt %, and more preferably from 3 wt % to 7 wt %, relative to the total amount of the metal nanoparticles 30, from the viewpoints of thermal stability and oxidation resistance.

Furthermore, it is preferable that the magnetic metal particles 10 contain carbon or nitrogen alone or in co-presence in an amount of from 0.001 atom % to 20 atom %, preferably from 0.001 atom % to 5 atom %, and more preferably from 0.01 atom % to 5 atom %, relative to the total amount of the magnetic metal particles 10. At least one of carbon and nitrogen can increase the magnetic anisotropy of the magnetic particles and increase the ferromagnetic resonance frequency by forming a solid solution with magnetic metals, and therefore, carbon and nitrogen can enhance the high frequency magnetic characteristics, which is preferable. If the content of at least one element selected from a group consisting of carbon and nitrogen is more than 20 atom %, solid solubility is decreased, and there is a risk that saturation magnetization of magnetic particles may be decreased. Regarding a more preferred amount from the viewpoints of high saturation magnetization and solid solubility, it is preferable that carbon or nitrogen be incorporated in an amount in the range of from 0.001 atom % to 5 atom %, and more preferably from 0.01 atom % to 5 atom %.

A preferred example of the composition of the magnetic metal particles 10 is a product such as described below. For example, it is preferable that the magnetic metal particles 10 contain Fe and Ni and contain at least one element selected from a group consisting of Al and Si; Fe be contained in an amount of from 40 atom % to 60 atom % relative to the total amount of Fe and Ni; at least one element selected from the group consisting of Al and Si be contained in an amount of from 0.001 wt % to 20 wt %, and more preferably from 2 wt % to 10 wt %, relative to the total amount of Fe and Ni; and oxygen be contained in an amount of from 0.1 wt % to 20 wt %, preferably from 1 wt % to 10 wt %, and more preferably from 3 wt % to 7 wt %, relative to the total amount of the metal nanoparticles 30. Also, more preferably, it is preferable that the magnetic metal particles 10 contain carbon in an amount of from 0.001 atom % to 20 atom %, preferably from 0.001 atom % to 5 atom %, and more preferably from 0.01 atom % to 5 atom %, relative to the total amount of the magnetic metal particles 10. In regard to the above-described example, it is also preferable from the viewpoint of high saturation magnetization that Fe and Ni be substituted by Fe and Co, and the amount of Co be adjusted to the range of from 10 atom % to 50 atom %, and more preferably from 20 atom % to 40 atom %, relative to the total amount of Fe and Co.

Next, the means for forming a coating layer 12 on at least a portion of the surface of the magnetic metal particles 10 is also not particularly limited, and examples include a liquid phase coating method, a partial oxidation method, and a gas phase method such as vapor deposition or sputtering.

Examples of the liquid phase coating method include a sol-gel method, a dip coating method, a spin coating method, a co-precipitation method, and a plating method. These methods can conveniently form a compact and uniform coating layer at a low temperature, and therefore, it is preferable. Among them, particularly the sol-gel method is preferred from the viewpoint that a compact film can be produced conveniently. Furthermore, when an appropriate heat treatment is applied at the time of forming a coating layer, a coating is formed compactly and uniformly, and therefore, it is preferable. The heat treatment is preferably carried out at a temperature of from 50° C. to 800° C., and more preferably from 300° C. to 500° C. The atmosphere is preferably a vacuum atmosphere or a reducing atmosphere of $H_2$, CO, $CH_4$ or the like. This is because the magnetic particles can be prevented from being oxidized and deteriorated during heating molding.

The partial oxidation method is a method of synthesizing magnetic metal particles 10 containing a magnetic metal and a non-magnetic metal, subsequently performing a partial oxidation treatment under appropriate oxidizing conditions, and thereby precipitating an oxide containing the non-magnetic metal on the surface of the magnetic metal particles 10, as a coating layer 12. Furthermore, when this partial oxidation method is applied to the formation of a coating layer 12 of a nitride, a carbide or a fluoride, a partial nitridation treatment, a partial carbonization treatment or a partial fluorination treatment may be carried out instead of a partial oxidation treatment.

This technique causes precipitation of oxides through diffusion, and when compared with a liquid phase coating method, this technique is preferred because the interface between the magnetic metal particles 10 and the oxide coating layer firmly adheres to the magnetic metal particles and the oxide coating layer, and thermal stability and oxidation resistance of the magnetic metal particles 10 are increased, which is preferable. The conditions for partial oxidation are not particularly limited; however, it is preferable that oxidation be carried out in an oxidizing atmosphere of $O_2$, $CO_2$ or the like by adjusting the oxygen concentration, at a temperature in the range of from room temperature to 1000° C.

Meanwhile, the coating may be carried out during the process for synthesizing the magnetic metal particles 10. That is, core-shell type magnetic metal particles containing an oxide coating layer containing a non-magnetic metal on the surface of magnetic metal particles 10 may also be synthesized by controlling the process conditions in the middle of synthesizing the magnetic metal particles 10 with heat plasma.

Furthermore, it is more preferable that the coating layer 12 be formed of an oxide, a composite oxide, a nitride, a carbide or a fluoride containing at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements. When the metal nanoparticles 30 containing at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, it is more preferable that the coating layer 12 be composed of an oxide, a composite oxide, a nitride, a carbide or a fluoride containing at least one of non-magnetic metals that are the same as the non-magnetic metals, which constitute one constituent component of the metal nanoparticles 30. Thereby, the adhesiveness between the metal nanoparticles 30 and the coating layer 12 can be increased, and the thermal stability and oxidation resistance of the magnetic material can be enhanced.

Meanwhile, in regard to the configuration of the coating layer 12 described above, any of an oxide, a composite oxide, a nitride, a carbide or a fluoride may be employed; however, among them, it is more preferable that the coating layer 12 be composed of an oxide or a composite oxide in particular. This is because of the ease of formation of the coating layer 12, oxidation resistance, and thermal stability.

Furthermore, it is preferable that an oxide or composite oxide coating layer be composed of an oxide or a composite oxide containing at least one magnetic metal, which is a constituent component of the magnetic metal particles 10, and be composed of an oxide or a composite oxide containing at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements.

This non-magnetic metal is an element which has low standard Gibbs energy of generation of an oxide, and can easily form a stable oxide. An oxide coating layer formed of an oxide or a composite oxide containing at least one or more of such non-magnetic metals, can enhance the adhesiveness and bondability to the magnetic metal particles 10, and the thermal stability and oxidation resistance of the magnetic metal particles 10 can also be enhanced.

Among the non-magnetic metals, Al and Si are preferable because these elements can easily form solid solutions with Fe, Co and Ni, which are main components of the magnetic metal particles 10, and contribute to an enhancement of thermal stability of the magnetic metal particles 10. Composite oxides containing plural kinds of non-magnetic metals also include the form of solid solutions. The coating layer 12 that covers at least a portion of the surface of the magnetic metal particles 10 can enhance the oxidation resistance of the internal magnetic metal particles 10, and also can enhance the electrical resistance of the particle aggregates obtained after the subsequent processing. When the electrical resistance is increased, an eddy current loss at a high frequency can be suppressed, and thus the high frequency characteristics of the magnetic permeability can be enhanced. For this reason, it is preferable that the coating layer 12 have high electrical resistance, and for example, it is preferable that the coating layer 12 have a resistance value of 1 mΩ·cm or more.

As the coating layer 12 is thicker, the electrical resistance of the particle aggregates is increased, and the thermal stability and oxidation resistance of the metal nanoparticles are also increased. However, if the coating layer 12 is made too thick, since the saturation magnetization is lowered, the magnetic permeability also becomes lower, which is not preferable. In order to make the saturation magnetization higher while maintaining the electrical resistance to be large to a certain extent, it is more preferable that the coating layer 12 have an average thickness of from 0.1 nm to 5 nm.

In regard to the magnetic metal particles 10 or core-shell type magnetic particles 20 prepared as such, it is preferable that the particle size distribution of the particles have a first peak at a particle size of more than or equal to 5 nm but less than 50 nm, and a second peak having a particle size of more than or equal to 50 nm but less than 10 μm. Meanwhile, it is similarly preferable even if the particle size distribution is not a bimodal particle size distribution (having two peaks in the particle size distribution) as such, but is a multimodal particle size distribution (having a number of peaks such as three or more peaks in the particle size distribution). Thereby, the processing treatment in the subsequent second step (pulverizing and reaggregating the magnetic metal particles) proceeds easily, and compositization (formation of particle aggregates formed from metal nanoparticles 30 and an interstitial phase 32) occurs easily, which is preferable. At this time, the magnetic metal phase (magnetic metal nanoparticles) contained in the particle aggregates is rearranged and forms a uniformly dispersed structure with less aggregation, and the particle size distribution becomes a single particle size distribution and becomes a sharp particle size distribution with less variation. That is, a particle size distribution that is originally bimodal or multimodal may be easily converted to a single sharp particle size distribution by processing. This is speculated to be because when individual particles are compositized, if the particle size distribution is bimodal or multimodal, energy is efficiently transferred, and the individual particles can easily fuse with one another. Also, since compositization is easily achieved, strain is not likely to occur in the interior, and thereby an increase in the coercivity is not likely to occur. This is also preferable from the viewpoint of a decrease in the hysteresis loss. Furthermore, the magnetic permeability is also enhanced, which is preferable. In addition, since compositization occurs easily, the process can be simplified, and this is also preferable from the viewpoints of product yield and cost reduction. Also, since a structure having excellent dispersibility in which the individual magnetic metal phases (magnetic metal nanoparticles) contained in particle aggregates are surrounded by an interstitial phase 32, is likely to be formed, the thermal stability and oxidation resistance of the magnetic metal phase (that is, of the particle aggregates) are dramatically enhanced. Moreover, high strength and high toughness can be obtained by this dispersed structure, which is preferable. Particularly, in regard to a composite structure of particle aggregates in which two different phases (magnetic metal phase and interstitial phase 32) are highly dispersed, when compared with the case of having a simple single phase, or with the case of a structure having two phases in a state of poor dispersibility, high strength and high toughness can be realized by a pinning effect or the like, which is preferable.

Meanwhile, the measurement of the particle size distribution can be carried out with, for example, a commercially available laser diffraction type particle size distribution meter utilizing a laser diffraction/scattering method. Furthermore, the particle size distribution can also be calculated by performing an image analysis of images obtained by TEM or SEM observation. Here, in the case of using core-shell type magnetic particles 20, the overall particle size combining a magnetic metal particle 10 and a coating layer 12 is measured. Also, in the case of using a magnetic metal particle 10 which lacks a coating layer 12, the particle size of the magnetic metal particle 10 is measured. In the method for laser diffraction type particle size distribution, if the dispersed state of a solution having particles dispersed therein, accurate measurement of the particle size distribution may be difficult. On the other hand, in the image analysis by TEM or SEM observation, if particles are in an aggregated state, it may be difficult to perform an analysis. Therefore, it is preferable to select an appropriate optimal technique, and comprehensively determining the particle size distribution while optionally using the two measurement methods together.

Next, the second step of forming composite particles (particle aggregates) by pulverizing and reaggregating the magnetic metal particles 10 or core-shell type magnetic particles 20 (processing treatment step) is explained. This step is a step preferable for realizing excellent magnetic characteristics, thermal stability, oxidation resistance, strength and toughness, by rearranging the magnetic metal phase (magnetic metal nanoparticles) in the particle aggregates to be synthesized, and obtaining a uniformly dispersed structure with less aggregation and a sharp structure with a single particle size distribution, as described above. In the present step, the magnetic metal particles 10 or the core-shell type magnetic particles 20 are pulverized, and the primary particle size of the magnetic metal phase is micronized, while at the same time, the micronized magnetic metal phase is reaggregated and becomes larger macroscopically. At this time, the behavior of micronization of the primary particle size of the magnetic metal phase can be simply investigated by observation by TEM or by the measurement of crystal grain size by XRD (utilizing Scherrer's formula). Furthermore, the behavior of the particles reaggregating and macroscopically increasing in size can be investigated by observation by SEM or TEM. The present processing treatment step is a step of forming particle aggregates and is not particularly limited; however, for example, a treatment of relatively easily pulverizing and reaggregating particles using a high power mill apparatus or the like (composite integration treatment) can be carried out. Alternatively, the present processing treatment step can also be carried out by a treatment of reaggregating particles by an electrochemical method such as an electrophoresis method or an electrodeposition method, while pulverizing (or dissolving and evaporating) the particles. Alternatively, the treatment can also be carried out by a mechanofusion method, an aerosol deposition method, a supersonic free jet physical vapor deposition (PVD) method, a supersonic flame thermal spray method, an ultrasonic spray coating method, a spray method or the like, or a method equivalent thereto.

Regarding the high power mill apparatus, an apparatus capable of applying a strong gravitational acceleration is preferred; however, the kind of the apparatus is not particularly selected (examples include a planetary mill, a bead mill, a rotary ball mill, a vibratory ball mill, an agitating ball mill (attriter), a jet mill, a centrifuge, and techniques combining milling and centrifugation), and for example, a High Power Planetary Mill apparatus and the like that are capable of applying a gravitational acceleration of several ten G are preferred. In the case of a High Power Planetary Mill apparatus, a tilted type planetary mill apparatus in which the direction of rotational gravitational acceleration and the direction of revolutionary gravitational acceleration are not directions on the same straight line but are directions forming an angle, is more preferred. In conventional planetary mill apparatuses, the direction of rotational gravitational acceleration and the direction of revolutionary gravitational acceleration are directions on the same straight line; however, in a tilted type planetary mill apparatus, since the vessel performs a rotating movement in a tilted state, the direction of rotational gravitational acceleration and the direction of revolutionary gravitational acceleration are not on the same straight line but form an angle. Thereby, power is efficiently transferred to a sample, and compositization and flattening proceed with high efficiency, which is preferable. Furthermore, regarding the gravitational acceleration, if possible, it is preferable to apply a gravitational acceleration of from 40 G to 1000 G, and more preferably from 100 G to 1000 G.

Furthermore, in consideration of mass production, a bead mill apparatus that can facilitate treatment of large quantities is preferred. That is, in the case of a process considering mass productivity, it is desirable that first, metal nanoparticles 30 be synthesized by a liquid phase synthesis method such as a polyol method, a thermal decomposition method, a reverse micelle method, a co-precipitation method, a mechanochemical method, or a mechanofusion method, subsequently an interstitial phase 32 (coating layer) of an oxide be formed on at least a portion of the surface of the metal nanoparticles 30 by a liquid phase coating method such as a sol-gel method, a dip coating method, a spin coating method, a co-precipitation method, or a plating method, and then the metal nanoparticles 30 and the interstitial phase 32 be integrated using a bead mill apparatus. This combination is preferable because since the various processes are commonized to be liquid phase processes, a continuous treatment is facilitated, a large amount can be subjected to treatment all at once, and the production cost can be decreased, which is preferable. Furthermore, since liquid phase processes can synthesize homogeneous materials having refined structures liquid phase processes can realize excellent magnetic characteristics (high magnetic permeability, low loss, high saturation magnetization, and the like). Thus, liquid phase processes are preferable.

In regard to the composite integration treatment using a high power mill apparatus, it is preferable that the metal nanoparticles 30 containing the interstitial phase 32 be processed with a wet type mill together with balls having a diameter of from 0.1 mm to 10 mm and a solvent. The solvent is preferably a solvent in which particles can be dispersed therein, and a ketone-based solvent, particularly acetone, is preferred. Furthermore, the diameter of the ball is preferably from 0.1 mm to 5 mm, and more preferably from 0.1 mm to 2 mm. If the diameter of the ball is too small, recovery of a powder is made difficult, and yield does not increase, which is not preferable. On the other hand, if the diameter of the ball is too large, the probability at which the powder is brought into contact is decreased, and compositization and flattening are not likely to proceed, which is not preferable. If efficiency is to be considered, the ball diameter is preferably from 0.1 mm to 5 mm, and more preferably from 0.1 mm to 2 mm. Also, the weight ratio of the balls with respect to the sample powder may vary depending on the ball diameter, but the weight ratio is more preferably from 10 to 80. In regard to the composite integration treatment using a high power mill apparatus, strain may occur in the material depending on the conditions, and this leads to an increase in the coercivity (when the coercivity increases, the hysteresis loss is increased, and the magnetic losses are increased), which is not preferable. It is preferable to select conditions in which the composite integration treatment can be efficiently carried out without applying any unnecessary strain to the material.

Furthermore, when a high power mill apparatus is used, it is preferable to perform the operation in an inert gas atmosphere in order to suppress oxidation of the magnetic nanoparticles as far as possible. Also, when the composite integration treatment of a powder is carried out under dry conditions (solvent-less processing treatment), the composite integration treatment may proceed easily; however, the structure is prone to be coarsened, and collection of the particles becomes difficult. Also, the shape of the particles thus obtainable becomes spherical in many cases.

On the other hand, when the composite integration treatment is carried out under wet conditions using a liquid solvent (processing treatment with solvent incorporation), it is preferable because coarsening of the structure is suppressed, and the shape can be easily flattened. It is more preferable to perform a treatment for suppressing coarsening of the structure while promoting composite integration, by performing both the dry treatment and the wet treatment.

Particle aggregates can be easily synthesized by using such techniques, and depending on the synthesis conditions, making the shape of the particle aggregates into a flat shape with a large aspect ratio can also be easily realized, which is preferable. By producing composite particles having a large aspect ratio, shape-induced magnetic anisotropy can be imparted, and when the directions of the axes of easy magnetization are aligned in a single direction, the magnetic permeability and the high frequency characteristics of the magnetic permeability can be enhanced, which is preferable.

Next, the third step of heat-treating the composite particles (particle aggregates) at a temperature of from 50° C. to 800° C. is explained. The present process is a process effective for releasing the strain generated when the particle aggregates are synthesized. The temperature is preferably from 50° C. to 800° C., and a temperature of from 300° C. to 500° C. is more preferred. When the temperature is set to this temperature range, the strain applied to the particle aggregates can be effectively released and relieved. Thereby, the coercivity that has been increased by strain can be decreased, and the hysteresis loss can be decreased (magnetic losses can be decreased). Also, since the coercivity can be decreased, the magnetic permeability can be enhanced. Meanwhile, the heat treatment of the present process is preferably carried out in an atmosphere of a low oxygen concentration or in a vacuum atmosphere; however, more preferably, a reducing atmosphere of $H_2$, CO, $CH_4$ or the like is preferred. Then, even if the particle aggregates are oxidized, the oxidized metal can be reduced and returned to metal by subjecting the particle aggregates to a heat treatment in a reducing atmosphere. Through this, the particle aggregates that have been oxidized and have the saturation magnetization decreased can be reduced, and thereby the saturation magnetization can be recovered (magnetic permeability can also be enhanced). Meanwhile, for the heat treatment, it is preferable to select conditions in which aggregation or necking of the magnetic particles is suppressed as far as possible.

When the above-described steps are carried out, the magnetic characteristic of the magnetic material can be enhanced to a large extent. That is, crystal strain is decreased, the coercivity is decreased, consequently the hysteresis loss is also decreased, and thus the magnetic permeability is enhanced. Furthermore, since a structure in which individual magnetic metal nanoparticles are surrounded by a second phase (interstitial phase 32) by rearrangement of the magnetic metal phase, is easily formed, the thermal stability and oxidation resistance of the magnetic metal particles 10 are dramatically enhanced. Furthermore, high strength and high toughness can be obtained by the dispersed structure of the magnetic metal phase and the second phase, which is preferable. Particularly, in a composite structure in which two different phases (magnetic metal phase and second phase) are highly dispersed, when compared with the case of having a simple single phase, or with the case of a structure having two phases in a state of poor dispersibility, high strength and high toughness can be realized by a pinning effect or the like, and this is preferable even from the viewpoint of mechanical characteristics.

Furthermore, crystal strain can be calculated by analyzing the line widths of XRD in detail. That is, the contributions of spreading of line widths can be separated into the crystal grain size and the crystal strain by applying the Halder-Wagner plot, the Hall-Williamson plot, and the like. Thereby, the crystal strain can be calculated. When the crystal strain (crystal strain (root mean square)) of the magnetic metal phase obtained by the Halder-Wagner plot described below is from 0.001% to 0.3%, low coercivity, low hysteresis loss, high magnetic permeability, high thermal stability, and high oxidation resistance are obtained, which is preferable. Here, the Halder-Wagner plot is represented by the following formula:

[Mathematical Formula 1]

$$\frac{\beta^2}{\tan^2\theta} = \frac{K\lambda}{D}\frac{\beta}{\tan\theta\sin\theta} + 16\varepsilon^2,$$

$$\varepsilon = \varepsilon_{max} = \frac{\sqrt{2\pi}}{2}\sqrt{\overline{\varepsilon^2}}$$

$$\left(\begin{array}{c} \beta\text{: width of integration, } K \\ K\text{: constant,} \\ \lambda\text{: wavelength,} \\ D\text{: crystal grain size,} \\ \sqrt{\overline{\varepsilon^2}}\text{ : crystal strain (root mean square)} \end{array}\right)$$

As such, a magnetic material including magnetic particles, which are particle aggregates containing metal nanoparticles 30 that have an average particle size of from 1 nm to 100 nm, preferably from 1 nm to 20 nm, and more preferably from 1 nm to 10 nm, and contain at least one magnetic metal selected from the group consisting of Fe, Co and Ni; and an interstitial phase 32 that is present between the metal nanoparticles 30 and contains at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, and any one of oxygen (O), nitrogen (N) or carbon (C), the particle aggregates having a shape with an average short dimension of from 10 nm to 2 μm, and preferably from 10 nm to 100 nm, and an average aspect ratio of 5 or more, and preferably 10 or more, and in which particles the volume packing ratio of the metal nanoparticles 30 relative to the entirety of the particle aggregates is from 40 vol % to 80 vol %, can be produced with high product yield and in a state of having high stability over time.

After the step of forming the particle aggregates, it is preferable to carry out the following step. That is, it is preferable to include a step of mixing the particle aggregates and a binder phase, and obtaining a mixed powder; a step of molding the mixed powder at a pressing pressure of 0.1 $kgf/cm^2$ or more; and a step of heat-treating the resultant after molding at a temperature of from 50° C. to 800° C., and preferably from 300° C. to 500° C. More preferably, it is preferable to add a step of coating the surface of the particle aggregates with a coating layer, before the step of mixing the particle aggregates and a binder phase and obtaining a mixed powder.

In the case of coating the surface of the particle aggregates with a coating layer, the coating layer may be any of an organic system or an inorganic system; however, when thermal resistance is considered, an inorganic system is preferred. Examples of the organic system include a silane coupling agent, a silicone resin, a polysilazane, a polyvinyl butyral resin, a polyvinyl alcohol system, an epoxy system, a polybutadiene system, a TEFLON system, a polystyrene-based resin, a polyester-based resin, a polyethylene-based resin, a polyvinyl chloride-based resin, a polyurethane resin, a cellulose-based resin, an ABS resin, a nitrile-butadiene-based rubber, a styrene-butadiene-based rubber, a phenolic resin, an amide-based resin, an imide-based resin, and copolymers thereof. Preferred examples of the inorganic system include oxides containing at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and rare earth elements. Particularly preferred examples are oxides containing Al or Si. Other preferred examples of the oxides include eutectic oxides and glasses, and preferred examples include $B_2O_3$—$SiO_2$, $B_2O_3$—$Cr_2O_3$, $B_2O_3$—$MoO_3$, $B_2O_3$—$Nb_2O_5$, $B_2O_3$—$Li_2O_3$, $B_2O_3$—BaO, $B_2O_3$—ZnO, $B_2O_3$—$La_2O_3$, $B_2O_3$—$P_2O_5$, $B_2O_3$—$Al_2O_3$, $B_2O_3$—$GeO_2$, $B_2O_3$—$WO_3$, $B_2O_3$—$Cs_2O$, $B_2O_3$—$K_2O$, $Na_2O$—$SiO_2$, $Na_2O$—$B_2O_3$, $Na_2O$—$P_2O_5$, $Na_2O$—$Nb_2O_5$, $Na_2O$—$WO_3$, $Na_2O$—$MoO_3$, $Na_2O$—$GeO_2$, $Na_2O$—$TiO_2$, $Na_2O$—$As_2O_5$, $Na_2O$—$TiO_2$, $Li_2O$—$MoO_3$, $Li_2O$—$SiO_2$, $Li_2O$—$GeO_2$, $Li_2O$—$WO_3$, $Li_2O$—$V_2O_5$, $Li_2O$—$GeO_2$, $K_2O$—$SiO_2$, $K_2O$—$P_2O_5$, $K_2O$—$TiO_2$, $K_2O$—$As_2O_5$, $K_2O$—$O_3$, $K_2O$—$MoO_3$, $K_2O$—$V_2O_5$, $K_2O$—$Nb_2O_5$, $K_2O$—$GeO_2$, $K_2O$—$Ta_2O_5$, $Cs_2O$—$MoO_3$, $Cs_2O$—$V_2O_5$, $Cs_2O$—$Nb_2O_5$, $Cs_2O$—$SiO_2$, CaO—$P_2O_5$, CaO—$B_2O_3$, CaO—$V_2O_5$, ZnO—$V_2O_5$, BaO—$V_2O_5$, BaO—$WO_3$, $Cr_2O_3$—$V_2O_5$, ZnO—$B_2O_3$, PbO—$SiO_2$, and $MoO_3$—$WO_3$. Among them, more preferred examples include $B_2O_3$—$SiO_2$, $B_2O_3$—$Cr_2O_3$, $B_2O_3$—$MoO_3$, $B_2O_3$—$Nb_2O_5$, $B_2O_3$—$Li_2O_3$, $B_2O_3$—BaO, $B_2O_3$—ZnO, $B_2O_3$—$La_2O_3$, $B_2O_3$—$P_2O_5$, $B_2O_3$—$Al_2O_3$, $B_2O_3$—$GeO_2$, $B_2O_3$—$WO_3$, $Na_2O$—$SiO_2$, $Na_2O$—$B_2O_3$, $Na_2O$—$P_2O_5$, $Na_2O$—$Nb_2O_5$, $Na_2O$—$WO_3$, $Na_2O$—$MoO_3$, $Na_2O$—$GeO_2$, $Na_2O$—$TiO_2$, $Na_2O$—$As_2O_5$, $Na_2O$—$TiO_2$, $Li_2O$—$MoO_3$, $Li_2O$—$SiO_2$, $Li_2O$—$GeO_2$, $Li_2O$—$WO_3$, $Li_2O$—$V_2O_5$, $Li_2O$—$GeO_2$, CaO—$P_2O_5$, CaO—$B_2O_3$, CaO—$V_2O_5$, ZnO—$V_2O_5$, BaO—$V_2O_5$, BaO—$WO_3$, $Cr_2O_3$—$V_2O_5$, ZnO—$B_2O_3$, and $MoO_3$—$WO_3$. Such combinations of oxides are preferable because the oxides have relatively low eutectic points and can easily produce eutectics. Particularly, combinations each having a eutectic point of 1000° C. or lower are preferred. Furthermore, the combination of oxides may be a combination of two or more, and examples include $Na_2O$—CaO—$SiO_2$, $K_2O$—CaO—$SiO_2$, $Na_2O$—$B_2O_3$—$SiO_2$, $K_2O$—PbO—$SiO_2$, BaO—$SiO_2$—$B_2O_3$, PbO—$B_2O_3$—$SiO_2$, and $Y_2O_3$—$Al_2O_3$—$SiO_2$. Other examples include La—Si—O—N, Ca—Al—Si—O—N, Y—Al—Si—O—N, Na—Si—O—N, Na—La—Si—O—N, Mg—Al—Si—O—N, Si—O—N, and Li—K—Al—Si—O—N. When the surface of the particle aggregates is coated with a coating layer, it is preferable because the insulating properties of the particle aggregates are markedly enhanced.

The technique for forming a coating layer is not particularly limited as long as it is a method capable of uniformly and compactly covering the surface. In the case of an inorganic coating layer, for example, a sol-gel method, a dip coating method, a spin coating method, a co-precipitation method, and a plating method are preferred because a compact and uniform coating layer can be formed conveniently at a low temperature. Furthermore, regarding the heat treatment temperature at the time of forming a coating layer, it is preferable to carry out the heat treatment at the lowest temperature at which coating can be carried out compactly and uniformly, and if possible, it is desirable to carry out the heat treatment at a heat treatment temperature of 400° C. or lower.

In the step of mixing the particle aggregates and a binder phase and obtaining a mixed powder, the means is not subject to selection as long as a method capable of mixing uniformly is employed. Preferably, it is preferable that the direction of gravitational acceleration applied to the particle aggregates at the time of mixing, be approximately consistent with the direction of the gravitational acceleration applied to the particle aggregates at the time of synthesizing the particle aggregates by processing the particle aggregates with the high power mill apparatus. Furthermore, it is preferable to adjust the magnitude of the gravitational acceleration applied to the particle aggregates at the time of mixing, to be smaller than the magnitude of the gravitational acceleration applied to the particle aggregates when the particle aggregates are synthesized by processing the particle aggregates with the high power mill apparatus. Thereby, unnecessary strain being applied to the sample can be suppressed. Also, unnecessary crushing of the sample can be suppressed, and therefore, it is preferable. From such a point of view, in the present step, mixing methods such as ball milling and stirrer agitation are preferred. The binder phase may be any of an organic system or an inorganic system, similarly to the case of the coating layer; however, when heat resistance is considered, an inorganic binder phase is preferred. Regarding both the organic systems and inorganic system, preferred material compositions are the same as the material compositions in the case of the coating layer, and thus, further description will not be repeated here. The combination of the coating layer and the binder phase is not particularly limited, and may be any of a combination of inorganic system-inorganic system, a combination of inorganic system-organic system, a combination of organic system-inorganic system, and a combination of organic system-organic system. However, from the viewpoint of heat resistance, a combination of an inorganic system-inorganic system is particularly preferred.

In the step of forming a mixed powder at a pressing pressure of 0.1 kgf/cm$^2$ or more, techniques such as a uniaxial press molding method, a hot press molding method, a cold isostatic pressing (CIP) (isotropic pressure molding) method, a hot isostatic pressing (HIP) (hot isotropic pressing) method, and a spark plasma sintering (SPS) method may be employed. It is necessary to select conditions for satisfying high density and high saturation magnetization while satisfying high resistance. A particularly preferred pressing pressure is from 1 kgf/cm$^2$ to 6 kgf/cm$^2$. Particularly, in the case of performing molding while heating, such as in the case of hot pressing, HIP or SPS, it is preferable to perform the molding in an atmosphere of a low oxygen concentration. A vacuum atmosphere or a reducing atmosphere of $H_2$, CO, $CH_4$ or the like is preferred. This is to suppress deterioration by oxidation of the magnetic particles during heated molding.

The step of performing a post-molding heat treatment at a temperature of from 50° C. to 800° C., and preferably 300° C. to 500° C., is a process preferable for releasing the strain applied to the particle aggregates at the time of the mixing step or at the time of the molding step. Thereby, the coercivity that has been increased by strain can be decreased, and thereby the hysteresis loss can be decreased (magnetic losses can be decreased). Furthermore, the heat treatment of the present step is preferably carried out in an atmosphere of a low oxygen concentration. A vacuum atmosphere or a reducing atmosphere of $H_2$, CO, $CH_4$ or the like is preferred. This is to suppress deterioration by oxidation of the magnetic particles during heated molding. Furthermore, the step of heat treatment after molding may be carried out simultaneously with the molding step. That is, the molding treatment may also be carried out while performing a heat treatment under the same conditions as the heat treatment conditions employed at the time of the post-molding heat treatment step.

Meanwhile, after each of the steps, it is preferable to control the process conditions of each step so as to prevent oxidation of the magnetic particles and a subsequent decrease of the saturation magnetization. Depending on the cases, after each step, the saturation magnetization may be recovered by reducing the magnetic particles that have been oxidized and have the saturation magnetization decreased. Regarding the reducing conditions, it is preferable to perform the heat treatment at a temperature in the range of 100° C. to 1000° C. in a reducing atmosphere of $H_2$, CO, $CH_4$ or the like. At this time, it is preferable to select conditions in which aggregation and necking of the magnetic particles are suppressed as far as possible.

Examples of the morphology of the magnetic material include the bulk form described above (a pellet shape, a ring shape, a rectangular shape, or the like), as well as a film form including sheet, and a powder form. The technique for producing a sheet is not particularly limited; however, for example, a sheet can be produced by mixing the synthesized mixed particles of magnetic particles and oxide particles, a resin and a solvent to obtain a slurry, and applying and drying the slurry. Furthermore, a mixture of the mixed particles and a resin may be molded by pressing into a sheet form or a pellet form. Also, the mixed particles may be dispersed in a solvent and deposited by a method such as electrophoresis. When sheets are produced, it is desirable that the mixed particles be oriented in one direction, that is, a direction in which the easy axes of the individual magnetic particles are aligned. It is preferable because the magnetic permeability and the high frequency characteristics of the magnetic permeability of the magnetic material sheet in which the magnetic particles are gathered, are enhanced thereby. Examples of the means for orienting the particles include application and drying in a magnetic field, but there are no particular limitations. The magnetic sheet may be produced so as to have a laminated structure. The magnetic sheet can be easily made thicker by adopting a laminated structure, and also, the high frequency magnetic characteristics can be enhanced by alternately laminating a magnetic sheet and a non-magnetic insulating layer. That is, when a laminated structure produced by forming a magnetic layer containing magnetic particles into a sheet form having a thickness of 100 μm or less, and alternately laminating this sheet-like magnetic layer with a non-magnetic insulating oxide layer having a thickness of 100 μm or less, is adopted, the high frequency magnetic characteristics are enhanced. That is, by adjusting the thickness of a single layer of the magnetic layer to 100 μm or less, when a high frequency magnetic field is applied in an in-plane direction, the influence of a diamagnetic field can be reduced. Thus, not only the magnetic permeability can be increased, but also the high frequency characteristics of the magnetic permeability are enhanced. The lamination method is not particularly limited; however, lamination can be achieved by overlapping plural sheets of magnetic sheets, and compressing by a pressing method or the like, or by heating and sintering the magnetic sheets.

The magnetic material produced by the present embodiment provides high magnetic permeability in the MHz range of 100 kHz or more, low loss, high saturation magnetization, and high strength. Furthermore, a high product yield, a state of high stability over time, high thermal stability, and high oxidation resistance can also be realized.

The magnetic material produced by the present embodiment can be used in, for example, high frequency magnetic component parts such as inductors, choke coils, filters, and transformers; antenna substrates and component parts; and radio wave absorbers. The application in which the features of the magnetic material of the embodiment described above can be best utilized is an inductor element for power inductors. Particularly, when the magnetic material is applied to power inductors to which a high electric current is applied in the MHz range of 100 kHz or more, for example, in the 10 MHz range, the magnetic material may easily exhibit the effect. Examples of preferred specifications for the magnetic material for power inductors include high magnetic permeability, low magnetic losses (primarily low eddy current loss and low hysteresis loss), and satisfactory direct current superposition characteristics. In power inductors having a frequency band lower than 100 kHz, a silicon steel sheet, or existing materials such as a Sendust, an amorphous ribbon, a nanocrystalline ribbon, and a MnZn-based ferrite are used. However, production of a magnetic material which sufficiently satisfies the specifications required for power inductors in a frequency band of 100 kHz or higher is not easy. For example, the metal-based material described above causes a large eddy current loss at a frequency of 100 kHz or higher, and therefore, use of the metal-based material is not preferable. Also, MnZn ferrite or NiZn ferrite for dealing with high frequency bands have low saturation magnetization, and therefore, the direct current superposition characteristics are poor, which is not preferable. That is, a magnetic material which satisfies all of high magnetic permeability, low magnetic losses, and satisfactory direct current superposition characteristics in the MHz range of 100 kHz or higher, for example, in the 10 MHz range, has not been available, and there is a demand for the development of such a material.

From the same viewpoint, the magnetic material of the embodiment may be said to be a material which is excellent particularly in the characteristics of high magnetic permeability, low magnetic losses, and satisfactory direct current superposition characteristics. First, the eddy current loss can be decreased by high electrical resistance; however, particularly in the magnetic material described above, an oxide, a semiconductor, a carbide, a nitride, or a fluoride having high electrical resistance is included between magnetic particles or metal nanoparticles 30. For this reason, the electrical resistance can be increased, which is preferable.

Furthermore, the hysteresis loss can be decreased by lowering the coercivity (or magnetic anisotropy) of the magnetic material; however, for the magnetic material described above, the magnetic anisotropy of individual magnetic particles is low. Moreover, as the individual magnetic metal particles 10 magnetically interact with neighboring particles, the total magnetic anisotropy can be further decreased. That is, in the magnetic material described above, the eddy current loss as well as the hysteresis loss can be sufficiently decreased.

Furthermore, in order to realize satisfactory direct current superposition characteristics, it is preferable to suppress magnetic saturation, and in order to do so, a material having high saturation magnetization is preferred. From that point of view, the magnetic material of the embodiment described above is preferable because the total saturation magnetization can be made large by selecting magnetic metal particles 10 having high saturation magnetization in the inside. Meanwhile, the magnetic permeability generally increases as the saturation magnetization increases, or as the magnetic anisotropy decreases. For this reason, the magnetic material of the embodiment described above can also have enhanced magnetic permeability.

Furthermore, since the magnetic material of the above-described embodiment is likely to have a structure in which individual magnetic metal nanoparticles are surrounded by a second phase, the thermal stability and oxidation resistance of the magnetic metal particles 10 are enhanced. Furthermore, high strength and high toughness can be obtained by a dispersed structure of a magnetic metal phase and a second phase, and it is preferable even from the viewpoint of obtaining excellent mechanical characteristics. Particularly, in regard to a composite structure in which two different phases (a magnetic metal phase and a second phase) are highly dispersed, when compared with the case of having a simple single phase, or with the case of a structure having two phases in a state of poor dispersibility, high strength and high toughness can be easily realized by a pinning effect or the like, which is preferable.

The method for producing a magnetic material of the above embodiment can provide a magnetic material having excellent magnetic characteristics and mechanical characteristics as described above, with high product yield.

From the above viewpoint, the magnetic material of the embodiment described above may particularly easily exhibit the effect, when the magnetic material is applied to an inductor element in a power inductor to which a high electric current is applied, particularly in the MHz range of 100 kHz or higher, for example, in the 10 MHz range.

Meanwhile, the magnetic material of the embodiment described above can be used not only in a high magnetic permeability component part such as an inductor element, but also as an electromagnetic wave absorber, by varying the frequency band of use. In general, a magnetic material takes high $\mu''$ near a ferromagnetic resonance (FMR) frequency; however, in the magnetic material of the above embodiment, various magnetic losses other than the ferromagnetic resonance loss, for example, the eddy current loss and the magnetic domain wall resonance loss can be suppressed as far as possible. Therefore, in a frequency band sufficiently lower than the ferromagnetic resonance frequency, $\mu''$ can be decreased, while $\mu'$ can be increased. That is, since a single material can be used as a high magnetic permeability component part as well as an electromagnetic wave absorber, by varying the frequency band of use, which is preferable.

On the other hand, since materials developed as electromagnetic wave absorbers are usually designed so as to maximize $\mu''$ as far as possible by summing up all the losses composed of the ferromagnetic resonance loss and various magnetic losses (eddy current loss, magnetic domain wall resonance loss, and the like), it is not preferable to use a material that has been developed as an electromagnetic wave absorber, in high magnetic permeability component parts (high $\mu'$ and low $\mu''$) for inductor elements and antenna apparatuses, in any frequency band.

In order to apply the magnetic material to devices such as described above, the magnetic material can be subjected to various processing treatments. For example, in the case of a sintered product, mechanical processing such as polishing or cutting is applied, and in the case of a powder, mixing with a resin such as an epoxy resin or polybutadiene is applied. If necessary, a surface treatment is further applied. In a case in which the high frequency magnetic component part is an inductor, a choke coil, a filter, or a transformer, a coiling treatment is achieved. Examples of the most fundamental structure include an inductor element in which a ring-shaped magnetic material is provided with a coil wound around the material, and an inductor element in which a rod shaped magnetic material is provided with a coil wound around the material. Furthermore, a chip inductor element in which a coil and a magnetic material are integrated, a planar inductor element, and the like can also be used. A laminate type inductor element may also be used. Further, an inductor element having a transformer structure may also be considered. Indeed, these elements may have their structures and dimensions varied depending on the use and the required inductor element characteristics.

According to the present embodiment, devices having excellent characteristics can be realized.

Thus, embodiments of the present invention have been explained with reference to specific examples. The embodiments described above are only for illustrative purposes, and are not intended to limit the present invention. Furthermore, the constituent elements of the various embodiments may also be appropriately combined.

In the descriptions of the embodiments, descriptions on the parts that are not directly needed in the explanation of the present invention in connection with the magnetic material, the method for producing a magnetic material, an inductor element, and the like, were not repeated. However, necessary elements related to the magnetic material, the method for producing a magnetic material, and the inductor element can be appropriately selected and used.

In addition, all magnetic materials, methods for producing a magnetic material, and inductor elements that include the elements of the present invention and can be appropriately designed and modified by those skilled in the art, are construed to be included in the scope of the present invention. The scope of the present invention is to be defined by the scope of the claims and equivalents thereof.

EXAMPLES

Hereinafter, Examples 1 to 7 of the present invention will be described in more detail by making a comparison with Comparative Examples 1 to 4. In regard to the magnetic materials obtainable by Examples and Comparative Examples described below, the shape, average height, average aspect ratio, and resistivity of the magnetic particles; the shape, composition, particle size, packing ratio, and average interparticle distance of the metal nanoparticles 30; and the composition of the interstitial phase 32 are presented in Table 1. Meanwhile, the measurement of the average height of the magnetic particles is carried out by calculating the average value of plural particles based on a TEM observation or a scanning electron microscope (SEM) observation. The magnetic particles of the Examples are particle aggregates in which metal nanoparticles 30 are dispersed at a high density, and the average particle size of the metal nanoparticles 30 inside the magnetic particles is comprehensively determined based on the crystal grain size (using Scherrer's formula) obtained by a TEM observation and XRD. Furthermore, a composition analysis of a microstructure is carried out based on an analysis by energy dispersive X-ray spectroscopy, X-ray (EDX).

Example 1

Argon as a gas for plasma generation is introduced into a chamber of a high frequency induction thermal plasma apparatus at a rate of 40 L/min, and plasma is generated. To this plasma in the chamber, raw materials including a Fe powder having an average particle size of 5 μm, a Ni powder having an average particle size of 3 μm, and a Si powder having an average particle size of 5 μm are sprayed together with argon (carrier gas) at a rate of 3 L/min. FeNiSi magnetic particles obtainable by rapidly cooling the powders are subjected to a partial oxidation treatment, and thereby FeNiSi magnetic particles coated with Si—Fe—Ni—O are obtained. These core-shell type magnetic particles 20 coated with Si—Fe—Ni—O are subjected to a sieving treatment and a treatment for mixing particles of different particle sizes, and thereby, core-shell type magnetic particles 20 having a bimodal type particle size distribution with a first peak at 20 nm and a second peak at 100 nm are obtained (first step: preparing the magnetic metal particles). Subsequently, these core-shell type magnetic particles 20 are subjected to a flattening compositization treatment at a speed of rotation equivalent to a gravitational acceleration of about 60 G in an Ar atmosphere (second step: pulverizing and reaggregating the magnetic metal particles). Subsequently, a $H_2$ (hydrogen gas) heat treatment is carried out at a temperature of 400° C. (third step: heat-treating the composite particles), the particles thus obtained are molded, and thereby a magnetic material for evaluation is obtained. The magnetic material thus obtainable is a flat particle aggregate in which spherical metal nanoparticles 30 are packed in an oxide matrix (interstitial phase 32) at a high density.

Example 2

The production is carried out in the same manner as in Example 1, except that the Si powder used in Example 1 is changed to an Al powder having an average particle size of 3 μm. Meanwhile, the particle size distribution had a first peak at 20 nm and a second peak at 100 nm.

Example 3

The production is carried out in the same manner as in Example 1, except that the Ni powder used in Example 1 is changed to a Co powder having an average particle size of 5 μm, and the Si powder is changed to an Al powder having an average particle size of 3 μm. Meanwhile, the particle size distribution had a first peak at 20 nm and a second peak at 100 nm.

Example 4

The production is carried out in the same manner as in Example 1, except that the Ni powder used in Example 1 is changed to a Co powder having an average particle size of 5 μm. Meanwhile, the particle size distribution had a first peak at 20 nm and a second peak at 100 nm.

Example 5

The production is carried out in the same manner as in Example 1, except that the particle size distribution is changed to a multimodal type particle size distribution having a first peak at 20 nm, a second peak at 80 nm, and a third peak at 200 nm, by the sieving treatment and the treatment for mixing particles having different particle sizes used in Example 1.

Example 6

The production is carried out in the same manner as in Example 1, except that the partial oxidation treatment used in Example 1 is changed to a partial nitridation treatment, and thereby FeNiSi magnetic particles coated with Si—Fe—Ni—N are obtained. Meanwhile, the particle size distribution had a first peak at 20 nm and a second peak at 100 nm.

Example 7

The production is carried out in the same manner as in Example 1, except that the partial oxidation treatment used in Example 1 is changed to a partial carbonization treatment, and thereby FeNiSi magnetic particles coated with Si—Fe—Ni—C are obtained. Meanwhile, the particle size distribution had a first peak at 20 nm and a second peak at 100 nm.

Comparative Example 1

The production is carried out in the same manner as in Example 1, except that the particle size distribution is changed to a monodisperse type particle size distribution having a peak at 20 nm only, by the sieving treatment and the treatment for mixing particles of different particle sizes used in Example 1.

Comparative Example 2

The production is carried out in the same manner as in Example 2, except that the particle size distribution is changed to a monodisperse type particle size distribution having a peak at 20 nm only, by the sieving treatment and the treatment for mixing particles of different particle sizes used in Example 2.

Comparative Example 3

The production is carried out in the same manner as in Example 3, except that the particle size distribution is changed to a monodisperse type particle size distribution having a peak at 20 nm only, by the sieving treatment and the treatment for mixing particles of different particle sizes used in Example 3.

Comparative Example 4

The production is carried out in the same manner as in Example 4, except that the particle size distribution is changed to a monodisperse type particle size distribution having a peak at 20 nm only, by the sieving treatment and the treatment for mixing particles of different particle sizes used in Example 4.

The magnetic materials obtainable in Examples 1 to 7 are all flat particle aggregates in which spherical metal nanoparticles 30 are packed in an oxide matrix (interstitial phase 32) at a high density. Meanwhile, when the crystal strain of the magnetic metal nanoparticles (corresponding to the magnetic metal phase) in the subject magnetic materials is evaluated by applying the Halder-Wagner plot described above, it can be confirmed that the crystal strain is from 0.001% to 0.3% in all cases. Furthermore, the individual magnetic metal nanoparticles (corresponding to the magnetic metal phase) in the subject magnetic materials form a uniformly dispersed structure with less aggregation, and regarding the particle size distribution, monodisperse particle size distributions are obtained, while sharp particle size distributions with less variation are obtained. That is, particles having a particle size distribution that was originally bimodal or multimodal may be easily converted to particles having a sharp monodisperse particle size distribution by processing.

On the other hand, in Comparative Examples 1 to 4, when the crystal strain of the magnetic metal nanoparticles (corresponding to the magnetic metal phase) in the magnetic materials is evaluated by applying the Halder-Wagner plot described above, it can be confirmed that the crystal strain is larger than 0.3% in all cases. Furthermore, the individual magnetic metal nanoparticles (corresponding to the magnetic metal phase) in the magnetic materials have a conspicuous aggregated structure with poor dispersibility, and regarding the particle size distribution, even a multimodal particle size distribution or a monodisperse particle size distribution become a particle size distribution that is broader than those of corresponding Examples.

Next, for the materials for evaluation of Examples 1 to 7 and Comparative Examples 1 to 4, the real part of magnetic permeability (μ'), the magnetic permeability loss (μ−tan δ=μ"/μ'×100(%)), the change over time in the real part of magnetic permeability (μ') after 100 hours, and the yield (%) are evaluated as follows. The evaluation results are presented in Table 2.

1) Real Part of Magnetic Permeability, μ', and Magnetic Permeability Loss (μ−tan δ=μ"/μ'×100(%):

The magnetic permeability of a ring-shaped sample is measured using an impedance analyzer. The real part W and the imaginary part μ" at a frequency of 10 MHz are measured. Furthermore, the magnetic permeability loss, μ−tan δ, is calculated by the formula: μ"/μ'×100(%).

2) Change Over Time in Real Part of Magnetic Permeability, μ', after 100 Hours

A sample for evaluation is heated at a temperature of 60° C. in air for 100 hours, and then the real part of magnetic permeability, μ', is measured again. Thus, the change over time (real part of magnetic permeability, μ', after standing for 100 H/real part of magnetic permeability, μ', before standing) is determined.

3) Yield

One hundred samples for evaluation are produced, and the value of variance=(measured value−average value)/average value×100(%) is calculated for each of the real part of magnetic permeability, μ', and the change ratio over time in the real part of magnetic permeability, μ', after 100 hours. The number of samples for which the calculated value of variance is within the range of ±10% is measured, and yield is indicated as follows: yield (%)=(number of samples for which the calculated value of variance is within the range of ±10%/total number of samples for evaluation (100 samples))×100(%).

4) Strength Ratio

The flexural strength of a sample for evaluation is measured, and the strength ratio is indicated as the ratio of the flexural strength to the flexural strength of a comparative sample (=flexural strength of sample for evaluation/flexural strength of comparative sample). Meanwhile, the ratios of Examples 1, 5, 6 and 7 are indicated as ratios with respect to Comparative Example 1; the ratio of Example 2 is indicated as the ratio with respect to Comparative Example 2; the ratio of Example 3 is indicated as the ratio with respect to Comparative Example 3; and the ratio of Example 4 is indicated as the ratio with respect to Comparative Example 4.

TABLE 1

| | Magnetic particles (particle aggregates) | | | | | | | | | |
|---|---|---|---|---|---|---|---|---|---|---|
| | | | | | Metal nanoparticles | | | | | |
| | Structure | | | | | | | | Average | |
| | Shape | Average height (μm) | Average aspect ratio | Resistivity (μΩ · cm) | Shape | Composition | Particle size (nm) | Packing ratio (vol %) | interparticle distance (nm) | Interstitial phase Composition |
| Example 1 | Flat shape | 0.08 | 160 | 500 | Spherical shape | Fe—Ni—Si | 8 | 54 | 1 | Si—FeNi—O |
| Example 2 | Flat shape | 0.08 | 130 | 500 | Spherical shape | Fe—Ni—Al | 8 | 53 | 1 | Al—FeNi—O |
| Example 3 | Flat shape | 0.09 | 110 | 1000 | Spherical shape | Fe—Co—Al | 8 | 53 | 1 | Al—FeCo—O |
| Example 4 | Flat shape | 0.09 | 120 | 1000 | Spherical shape | Fe—Co—Si | 8 | 54 | 1 | Si—FeCo—O |
| Example 5 | Flat shape | 0.08 | 170 | 550 | Spherical shape | Fe—Ni—Si | 7 | 55 | 1 | Si—FeNi—O |
| Example 6 | Flat shape | 0.09 | 100 | 500 | Spherical shape | Fe—Ni—Si | 9 | 54 | 1 | Si—FeNi—N |
| Example 7 | Flat shape | 0.09 | 100 | 500 | Spherical shape | Fe—Ni—Si | 9 | 54 | 1 | Si—FeNi—C |
| Comparative Example 1 | Flat shape | 0.13 | 70 | 70 | Spherical shape | Fe—Ni—Si | 14 | 54 | 1 | Si—FeNi—O |
| Comparative Example 2 | Flat shape | 0.15 | 60 | 80 | Spherical shape | Fe—Ni—Al | 15 | 53 | 1 | Al—FeNi—O |
| Comparative Example 3 | Flat shape | 0.15 | 60 | 90 | Spherical shape | Fe—Co—Al | 16 | 53 | 1 | Al—FeCo—O |
| Comparative Example 4 | Flat shape | 0.16 | 50 | 80 | Spherical shape | Fe—Co—Si | 15 | 54 | 1 | Si—FeCo—O |

TABLE 2

| | Characteristics of high frequency magnetic material | | | | | |
|---|---|---|---|---|---|---|
| | Real part of magnetic permeability, μ' (10 MHz) | Magnetic permeability loss, μ-tanδ (%) (10 MHz) | Change ratio over time in real part of magnetic permeability, μ' (10 MHz), after 60° C. and 100 hr | μ' yield (%) | Yield of change ratio over time (%) | Strength ratio |
| Example 1 | 22 | <0.05 | 0.98 | 73 | 75 | 1.3 |
| Example 2 | 20 | <0.05 | 0.96 | 71 | 73 | 1.2 |
| Example 3 | 21 | <0.05 | 0.97 | 70 | 72 | 1.2 |
| Example 4 | 22 | <0.05 | 0.97 | 72 | 74 | 1.3 |
| Example 5 | 21 | <0.05 | 0.96 | 74 | 76 | 1.3 |
| Example 6 | 20 | <0.05 | 0.96 | 73 | 75 | 1.3 |
| Example 7 | 20 | <0.05 | 0.96 | 73 | 75 | 1.3 |
| Comparative Example 1 | 11 | 0.05~0.1 | 0.93 | 36 | 37 | — |
| Comparative Example 2 | 11 | 0.05~0.1 | 0.92 | 38 | 39 | — |
| Comparative Example 3 | 9 | 0.05~0.1 | 0.92 | 32 | 34 | — |
| Comparative Example 4 | 9 | 0.05~0.1 | 0.93 | 36 | 38 | — |

As is obvious from Table 1, the magnetic materials related to Example 1 to Example 7 include, as magnetic particles, flat-shaped particle aggregates in which metal nanoparticles having an average particle size of from 1 nm to 10 nm are packed at a packing ratio of from 40 vol % to 80 vol %. Furthermore, these magnetic particles have a shape with an average height of from 10 nm to 100 nm and an average aspect ratio of 10 or higher. The resistivity of the magnetic particles is from 100 μΩ·cm to 100 mΩ·cm. On the other hand, it can be seen that in Comparative Examples 1 to 4, the average height of the magnetic particles is larger than 100 nm, and the aspect ratio is also smaller, compared with Examples 1 to 7. This implies that Examples 1 to 7 are more likely to undergo flattening and nanocompositization as compared with Comparative Examples 1 to 4. It can be seen that Comparative Examples 1 to 4 have resistivities smaller than 100 μΩ·cm. Furthermore, in Comparative Examples 1 to 4, the average particle size of the metal nanoparticles is larger than 10 nm, and a structure finer than the structures of Examples 1 to 7 could not be realized. This implies that Examples 1 to 7 have superior dispersibility of metal nanoparticles inside the completed particle aggregates, as compared with Comparative Examples 1 to 4. Furthermore, in Examples 1 to 7, the crystal strain of the magnetic metal nanoparticles (corresponding to the magnetic metal phase) in the magnetic materials thus obtainable is from 0.001% to 0.3% in all cases, and the magnetic materials are preferable from the viewpoints of low coercivity, low hysteresis loss, high magnetic permeability, high thermal stability, and high oxidation resistance.

Table 2 discloses the real part of magnetic permeability (μ'), the magnetic permeability loss (μ–tan δ=μ"/μ'×100(%)), the change over time in the real part of magnetic permeability (μ') after 100 hours at 60° C., the μ' yield (%), and the yield of change over time (%). As can be clearly seen from Table 2, it is understood that the magnetic materials related to Example 1 to Example 7 are excellent in all of the real part of magnetic permeability, the magnetic permeability loss, the change ratio over time, the μ' yield (%), the yield of change over time (%), and the strength ratio, as compared with the materials of Comparative Examples.

It is speculated in regard to the materials of Examples 1 to 7 that when the particle size distribution before the processing treatment is adjusted to a bimodal distribution or a multimodal distribution, and the materials are synthesized through the first step (preparing the magnetic metal particles), the second step (the pulverizing and the reaggregating the magnetic metal particles) and the third step (heat-treating the composite particles), flattening and compositization proceed efficiently, and more uniform and homogeneous structures in a state of less strain are realized, so that excellent magnetic characteristics (real part of magnetic permeability, magnetic permeability loss, change ratio over time, and yield) and excellent mechanical characteristics (strength) can be realized. Furthermore, all of the materials realized high saturation magnetization of 0.7 T or higher.

Thus, it is understood that the magnetic materials related to Examples 1 to 7 have high real parts of magnetic permeability (μ') and low imaginary parts of magnetic permeability (μ") in the MHz range of 100 kHz or higher, and have high saturation magnetization, high thermal stability, high oxidation resistance, high yield, and high strength.

Example 8

The production was carried out in the same manner as in Example 1, except that the temperature at which the $H_2$ (hydrogen gas) heat treatment of Example 1 was carried out (third step: heat-treating the composite particles) was changed to 50° C.

Example 9

The production was carried out in the same manner as in Example 1, except that the temperature at which the $H_2$ (hydrogen gas) heat treatment of Example 1 was carried out (third step: heat-treating the composite particles) was changed to 300° C.

Example 10

The production was carried out in the same manner as in Example 1, except that the temperature at which the $H_2$ (hydrogen gas) heat treatment of Example 1 was carried out (third step: heat-treating the composite particles) was changed to 800° C.

Comparative Example 5

The production was carried out in the same manner as in Example 1, except that the temperature at which the $H_2$ (hydrogen gas) heat treatment of Example 1 was carried out (third step: heat-treating the composite particles) was changed to 30° C.

Comparative Example 6

The production was carried out in the same manner as in Example 1, except that the temperature at which the $H_2$ (hydrogen gas) heat treatment of Example 1 was carried out (third step: heat-treating the composite particles) was changed to 900° C.

Example 11

The production was carried out in the same manner as in Example 1, except that the gravitational acceleration (second step: pulverizing and reaggregating the magnetic metal particles) of Example 1 was changed to 40 G.

Example 12

The production was carried out in the same manner as in Example 1, except that the gravitational acceleration (second step) of Example 1 was changed to 500 G.

Example 13

The production was carried out in the same manner as in Example 1, except that the gravitational acceleration (second step: pulverizing and reaggregating the magnetic metal particles) of Example 1 was changed to 1000 G.

Comparative Example 7

The production was carried out in the same manner as in Example 1, except that the gravitational acceleration (second step: pulverizing and reaggregating the magnetic metal particles) of Example 1 was changed to 20 G.

Comparative Example 8

The production was carried out in the same manner as in Example 1, except that the gravitational acceleration (second step: pulverizing and reaggregating the magnetic metal particles) of Example 1 was changed to 1200 G.

The results obtained in Examples 8 to 13 and Comparative Examples 5 to 8 are summarized in Table 3 and Table 4.

TABLE 3

| | Magnetic particles (particle aggregates) | | | | | | | | | |
|---|---|---|---|---|---|---|---|---|---|---|
| | Structure | | | | Metal nanoparticles | | | | | |
| | Shape | Average height (μm) | Average aspect ratio | Resistivity (μΩ · cm) | Shape | Composition | Particle size (nm) | Packing ratio (vol %) | Average interparticle distance (nm) | Interstitial phase Composition |
| Example 8 | Flat shape | 0.07 | 180 | 600 | Spherical shape | Fe—Ni—Si | 7 | 54 | 1 | Si—FeNi—O |
| Example 9 | Flat shape | 0.08 | 160 | 500 | Spherical shape | Fe—Ni—Si | 8 | 54 | 1 | Si—FeNi—O |
| Example 10 | Flat shape | 0.09 | 140 | 150 | Spherical shape | Fe—Ni—Si | 10 | 54 | 1 | Si—FeNi—O |
| Example 11 | Flat shape | 0.09 | 120 | 500 | Spherical shape | Fe—Ni—Si | 8 | 54 | 1 | Si—FeNi—O |
| Example 12 | Flat shape | 0.06 | 200 | 400 | Spherical shape | Fe—Ni—Si | 9 | 54 | 1 | Si—FeNi—O |
| Example 13 | Flat shape | 0.04 | 400 | 200 | Spherical shape | Fe—Ni—Si | 10 | 54 | 1 | Si—FeNi—O |
| Comparative Example 5 | Flat shape | 0.07 | 180 | 600 | Spherical shape | Fe—Ni—Si | 6 | 54 | 1 | Si—FeNi—O |
| Comparative Example 6 | Flat shape | 0.12 | 90 | 60 | Spherical shape | Fe—Ni—Si | 15 | 54 | 1 | Si—FeNi—O |
| Comparative Example 7 | Flat shape | 0.13 | 90 | 80 | Spherical shape | Fe—Ni—Si | 12 | 54 | 1 | Si—FeNi—O |
| Comparative Example 8 | Flat shape | 0.03 | 500 | 90 | Spherical shape | Fe—Ni—Si | 13 | 54 | 1 | Si—FeNi—O |

TABLE 4

| | Characteristics of high frequency magnetic material | | | | | |
|---|---|---|---|---|---|---|
| | Real part of magnetic permeability, μ' (10 MHz) | Magnetic permeability loss, μ-tanδ (%) (10 MHz) | Change ratio over time in real part of magnetic permeability, μ' (10 MHz), after 60° C. and 100 hr | μ' yield (%) | Yield of change ratio over time (%) | Strength ratio |
| Example 8 | 20 | <0.05 | 0.97 | 71 | 73 | 1.2 |
| Example 9 | 22 | <0.05 | 0.98 | 72 | 74 | 1.3 |
| Example 10 | 20 | <0.05 | 0.97 | 70 | 72 | 1.1 |
| Example 11 | 21 | <0.05 | 0.96 | 72 | 74 | 1.3 |
| Example 12 | 21 | <0.05 | 0.96 | 73 | 75 | 1.2 |
| Example 13 | 20 | <0.05 | 0.95 | 71 | 72 | 1.1 |

TABLE 4-continued

| | Characteristics of high frequency magnetic material | | | | | |
|---|---|---|---|---|---|---|
| | Real part of magnetic permeability, μ' (10 MHz) | Magnetic permeability loss, μ-tanδ (%) (10 MHz) | Change ratio over time in real part of magnetic permeability, μ' (10 MHz), after 60° C. and 100 hr | μ' yield (%) | Yield of change ratio over time (%) | Strength ratio |
| Comparative Example 5 | 15 | 0.05~0.1 | 0.92 | 38 | 39 | 0.8 |
| Comparative Example 6 | 13 | 0.05~0.1 | 0.90 | 40 | 42 | 0.8 |
| Comparative Example 7 | 14 | 0.05~0.1 | 0.90 | 41 | 39 | 0.8 |
| Comparative Example 8 | 15 | 0.05~0.1 | 0.91 | 39 | 40 | 0.8 |

As described above, it is understood that the magnetic materials related to Examples 8 to 13 have high real parts of magnetic permeability (μ') and low imaginary parts of magnetic permeability (μ") in the MHz range of 100 kHz or higher, and have high saturation magnetization, high thermal stability, high oxidation resistance, high yield, and high strength.

Meanwhile, the Examples described above are examples that used core-shell type magnetic particles 20; however, similar results were obtained even when magnetic metal particles 10 having no coating layer 12 were used.

While certain embodiments have been described, these embodiments have been presented by way of example only, and are not intended to limit the scope of the inventions. Indeed, the method for producing a magnetic material described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. A method for producing a magnetic material, the method comprising:

preparing magnetic metal particles containing at least one magnetic metal selected from a first group consisting of iron (Fe), cobalt (Co) and nickel (Ni), and at least one non-magnetic metal selected from a second group consisting of magnesium (Mg), aluminum (Al), silicon (Si), calcium (Ca), zirconium (Zr), titanium (Ti), hafnium (Hf), zinc (Zn), manganese (Mn), barium (Ba), strontium (Sr), chromium (Cr), molybdenum (Mo), silver (Ag), gallium (Ga), scandium (Sc), vanadium (V), yttrium (Y), niobium (Nb), lead (Pb), copper (Cu), indium (In), tin (Sn) and rare earth elements, a particle size distribution of the magnetic metal particles having two or more peaks;

pulverizing and reaggregating the magnetic metal particles, and thereby forming composite particles containing a magnetic metal phase and an interstitial phase; and heat-treating the composite particles at a temperature of from 50° C. to 800° C., the magnetic material comprising: magnetic particles which are particle aggregates containing metal nanoparticles having an average particle size of from 1 nm to 100 nm and containing at least one magnetic metal selected from the group consisting of Fe, Co and Ni; and the interstitial phase provided between the metal nanoparticles and containing at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, and any one of oxygen (O), nitrogen (N) or carbon (C), the particle aggregates having a shape with an average short dimension of from 10 nm to 2 μm, an average aspect ratio of 5 or more, and the volume packing ratio of the metal nanoparticles relative to the entirety of the particle aggregates being from 40 vol % to 80 vol %.

2. The method according to claim 1, wherein during the pulverizing and the reaggregating, any one of oxygen (O), nitrogen (N) or carbon (C) is further incorporated into the magnetic metal particles.

3. The method according to claim 1, wherein the particle size distribution of the magnetic metal particles has a first peak at a particle size of more than or equal to 5 nm but less than 50 nm, and a second peak at a particle size of more than or equal to 50 nm but less than 10 μm.

4. The method according to claim 1, wherein the magnetic metal particles contain at least one additive metal different from the non-magnetic metals and selected from a third group consisting of boron (B), silicon (Si), carbon (C), titanium (Ti), zirconium (Zr), hafnium (Hf), niobium (Nb), tantalum (Ta), molybdenum (Mo), chromium (Cr), copper (Cu), tungsten (W), phosphorus (P), nitrogen (N), and gallium (Ga), at a proportion of from 0.001 atom % to 25 atom % relative to the total amount of the magnetic metal, the non-magnetic metal and the additive metal, and at least two of the magnetic metal, the non-magnetic metal and the additive metal form a solid solution of each other.

5. The method according to claim 1, wherein the composite particles comprise metal nanoparticles containing the magnetic metal; and the interstitial phase existing between the metal nanoparticles and containing the non-magnetic metal and any one of oxygen (O), nitrogen (N) or carbon (C), the total amount of the non-magnetic metal is from 0.001 wt % to 20 wt % relative to the total amount of the magnetic metal, and oxygen is included in an amount of 0.1 wt % to 20 wt % relative to the total amount of the metal nanoparticles.

6. The method according to claim 1, wherein the crystal structure of the magnetic metal particles is a hexagonal crystal structure.

7. The method according to claim 1, wherein the pulverizing and the reaggregating includes a process based on a processing treatment combining dry processing and wet processing.

8. The method according to claim 1, wherein the pulverizing and the reaggregating includes a process based on a processing treatment of applying a gravitational acceleration of from 40 G to 1000 G to the magnetic metal particles.

9. The method according to claim 1, wherein the crystal strain of the magnetic metal phase is from 0.001% to 0.3%.

10. A method for producing a magnetic material, the method comprising:

preparing core-shell type magnetic particles containing magnetic metal particles and a coating layer, the magnetic metal particles containing at least one magnetic metal selected from a first group consisting of Fe, Co and Ni, and at least one non-magnetic metal selected from a second group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, a particle size distribution of the magnetic metal particles having two or more peaks, and the coating layer covering at least a portion of the surface of the magnetic metal particles and containing at least one each of the magnetic metals and the non-magnetic metals included in the magnetic metal particles, as well as any one of oxygen (O), nitrogen (N) or carbon (C);

pulverizing and reaggregating the core-shell type magnetic particles, and thereby forming composite particles containing a magnetic metal phase and an interstitial phase; and heat-treating the composite particles at a temperature of from 50° C. to 800° C., the magnetic material comprising: magnetic particles which are particle aggregates containing metal nanoparticles having an average particle size of from 1 nm to 100 nm and containing at least one magnetic metal selected from the group consisting of Fe, Co and Ni; and the interstitial phase provided between the metal nanoparticles and containing at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn and rare earth elements, and any one of oxygen (O), nitrogen (N) or carbon (C), the particle aggregates having a shape with an average short dimension of from 10 nm to 2 μm, an average aspect ratio of 5 or more, and the volume packing ratio of the metal nanoparticles relative to the entirety of the particle aggregates being from 40 vol % to 80 vol %.

11. The method according to claim 10, wherein during the pulverizing and the reaggregating, any one of oxygen (O), nitrogen (N) or carbon (C) is further incorporated into the magnetic metal particles.

12. The method according to claim 10, wherein the particle size distribution of the core-shell type magnetic particles has a first peak at a particle size of more than or equal to 5 nm but less than 50 nm, and a second peak at a particle size of more than or equal to 50 nm but less than 10 μm.

13. The method according to claim 10, wherein the magnetic metal particles contain at least one additive metal different from the non-magnetic metals and selected from a third group consisting of B, Si, C, Ti, Zr, Hf, Nb, Ta, Mo, Cr, Cu, W, P, N and Ga, in an amount of from 0.001 atom % to 25 atom % relative to the total amount of the magnetic metal, the non-magnetic metal and the additive metal, and at least two of the magnetic metal, the non-magnetic metal and the additive metal form a solid solution of each other.

14. The method according to claim 10, wherein the composite particles contain the metal nanoparticles containing a magnetic metal; and the interstitial phase existing between the metal nanoparticles and containing the non-magnetic metal and any one of oxygen (O), nitrogen (N) or carbon (C), the total amount of the non-magnetic metal is from 0.001 wt % to 20 wt % relative to the total amount of the magnetic metal, and oxygen is included in an amount of from 0.1 wt % to 20 wt % relative to the total amount of the metal nanoparticles.

15. The method according to claim 10, wherein the crystal structure of the magnetic metal particles is a hexagonal crystal structure.

16. The method according to claim 10, wherein the pulverizing and the reaggregating includes a process based on a processing treatment combining dry processing and wet processing.

17. The method according to claim 10, wherein the pulverizing and the reaggregating includes a process based on a processing treatment of applying a gravitational acceleration of from 40 G to 1000 G to the core-shell type magnetic particles.

18. The method according to claim 10, wherein the crystal strain of the magnetic metal phase is from 0.001% to 0.3%.

19. The method according to claim 1, wherein the metal nanoparticles in the particle aggregates have a single particle size distribution.

20. The method according to claim 10, wherein the metal nanoparticles in the particle aggregates have a single particle size distribution.

* * * * *